US009318122B2

(12) United States Patent
Otani

(10) Patent No.: US 9,318,122 B2
(45) Date of Patent: Apr. 19, 2016

(54) AUDIO SIGNAL PROCESSING APPARATUS AND AUDIO SIGNAL PROCESSING METHOD

(71) Applicant: FUJITSU LIMITED, Kawasaki-shi, Kanagawa (JP)

(72) Inventor: Takeshi Otani, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/666,589

(22) Filed: Mar. 24, 2015

(65) Prior Publication Data

US 2015/0302864 A1 Oct. 22, 2015

(30) Foreign Application Priority Data

Apr. 18, 2014 (JP) ..... 2014-086738

(51) Int. Cl.

*G10L 21/0208* (2013.01)
*G10L 19/022* (2013.01)
*G10L 19/02* (2013.01)
*G10L 21/0316* (2013.01)

(52) U.S. Cl.

CPC ..... *G10L 21/0208* (2013.01); *G10L 19/022* (2013.01); *G10L 19/0212* (2013.01); *G10L 21/0316* (2013.01)

(58) Field of Classification Search

CPC ..... G10L 21/0208; G10L 19/0212; G10L 19/022
USPC ..... 704/203–205, 248, 268
See application file for complete search history.

(56) References Cited

U.S. PATENT DOCUMENTS 6,064,955 A * 5/2000 Huang ..... G10L 13/02 704/208
8,898,068 B2 * 11/2014 Subbaraman ..... G10L 19/0017 704/205
2005/0027520 A1 2/2005 Mattila et al.
2008/0059162 A1 * 3/2008 Otani ..... G10L 21/0208 704/226

(Continued)

FOREIGN PATENT DOCUMENTS

EP 0992978 A1 4/2000
EP 2172930 B1 2/2012
JP 2005-321821 A 11/2005

(Continued)

OTHER PUBLICATIONS

EESR—Extended European search report (EESR) dated Aug. 4, 2015 for corresponding European patent application No. 15159597.2.

*Primary Examiner* — Marcellus Augustin
(74) *Attorney, Agent, or Firm* — Fujitsu Patent Center

(57) ABSTRACT

A signal processing apparatus generates a window signal, transforms the window signal into a frequency spectrum, and adjusts an amplitude component of the frequency spectrum. Then, the signal processing apparatus applies inverse transform to the amplitude component after adjustment and to a phase component of the frequency spectrum to generate a frame signal, and identifies an overlap segment such that the absolute value of the amplitude of the frame signal at at least one end of the overlap segment becomes smaller than the absolute value of the amplitude of the frame signal at a corresponding end of an overlapping section. Then, in the identified segment, the signal processing apparatus adds and compounds the frame signal corresponding to an immediately preceding frame and the frame signal corresponding to a processing-target frame.

9 Claims, 18 Drawing Sheets

(56) References Cited

U.S. PATENT DOCUMENTS

| | | | | |
|---|---|---|---|---|
| 2011/0106529 | A1* | 5/2011 | Disch | G10L 19/0204 704/205 |
| 2015/0066487 | A1* | 3/2015 | Matsuo | G10L 19/0212 704/204 |

FOREIGN PATENT DOCUMENTS

| | | | |
|---|---|---|---|
| JP | 2008-58480 | A | 3/2008 |
| WO | 99/50825 | A1 | 10/1999 |
| WO | 2009/119460 | A1 | 10/2009 |

* cited by examiner

AUDIO SIGNAL PROCESSING APPARATUS AND AUDIO SIGNAL PROCESSING METHOD

CROSS-REFERENCE TO RELATED APPLICATION

This application is based upon and claims the benefit of priority of the prior Japanese Patent Application No. 2014-086738, filed on Apr. 18, 2014, the entire contents of which are incorporated herein by reference.

FIELD

The embodiments described herein relate to a signal processing apparatus and a signal processing method.

BACKGROUND

Signal processing apparatuses that apply noise suppression and the like after transforming an input signal in(t) into the frequency domain and then apply inverse transform into the time domain to output an output signal out(t) have been known.

In such signal processing apparatuses that are intended for noise suppression and the like, the input signal in(t) is divided into frames, and the input signal in(t) divided into frames is transformed into the frequency domain, and noise suppression and the like is applied in each frame in the frequency domain. Then, inverse transform into the time domain is applied, and a frame signal is generated for each frame. Then, the frame signal for the current frame and the frame signal for the immediately preceding frame are overlapped to generate the output signal out(t).

However, when the frame signal for the current frame and the frame signal for the immediately preceding frame are simply overlapped, discontinuity may appear at the frame boundary. The discontinuity is caused due to a suppression process (or an amplification process) applied to adjacent frames based on different suppression (or amplification) coefficients G(f).

Such discontinuity at the frame boundary causes noise, which is very uncomfortable to the ear of the listener.

As a method for solving this problem, for example, there is a method proposed in Patent Document 1. In the method proposed in Patent Document 1, for example, overlapping is performed after making the amplitudes at both ends of the frame signal by attaching a DC component, to solve the problem of discontinuity at the frame boundary.

[Patent Document 1] Japanese Laid-open Patent Publication No. 2008-58450

SUMMARY

A signal processing apparatus in one aspect is equipped with a processor which executes a process including generating a first frame signal by multiplying an input signal divided into frames of a prescribed frame length by a prescribed first window function; transforming the first frame signal into a frequency spectrum; adjusting an amplitude component of the frequency spectrum; applying inverse transform to the amplitude component after adjustment and to a phase component of the frequency spectrum to generate a second frame signal in a time domain; identifying a segment in an overlapping section between a processing-target frame and an immediately preceding frame such that an absolute value of an amplitude of the second frame signal at at least one end of the segment becomes smaller than an absolute value of an amplitude of the second frame signal at a corresponding end of the overlapping section; and in the identified segment, adding and compounding the second frame signal corresponding to the immediately preceding frame and the second frame signal corresponding to the processing-target frame.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Hereinafter, embodiments of the present invention are described in detail with reference to the drawings.

Embodiment 1 is described.

Figure 1:
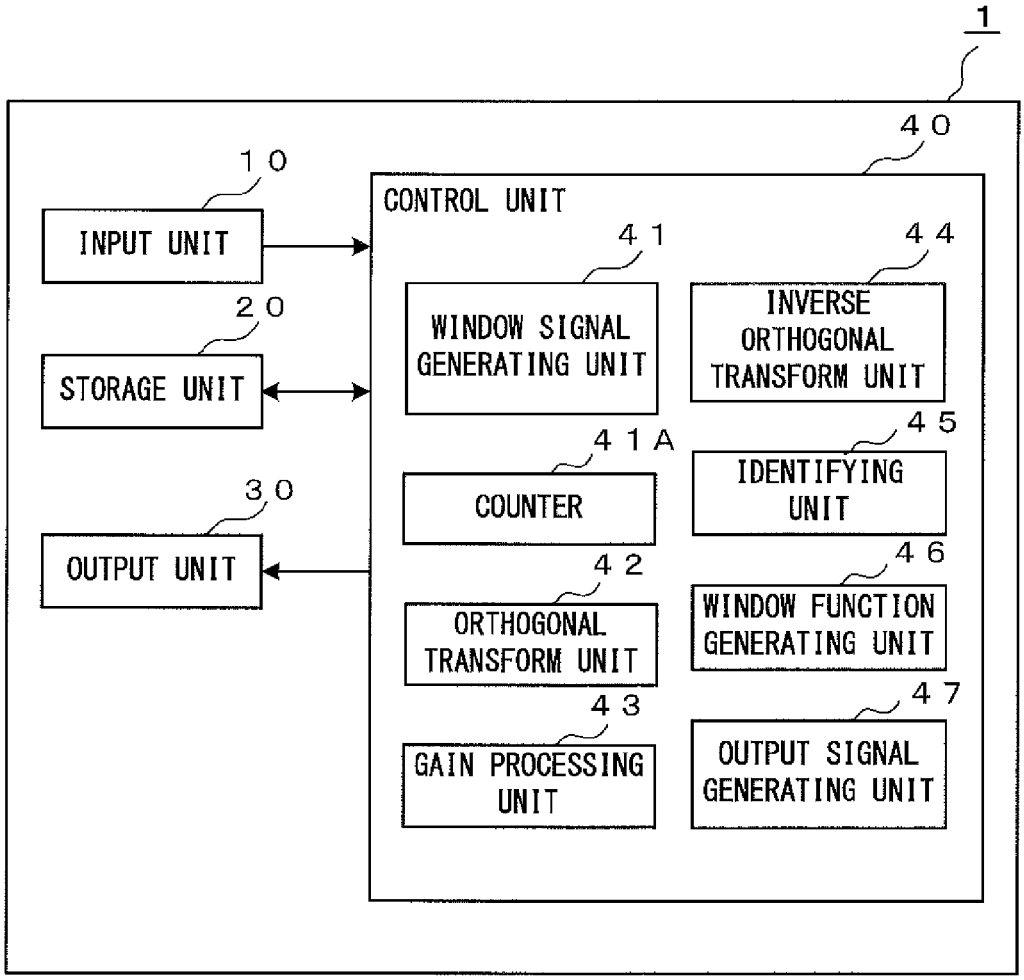
FIG. 1 is a functional block diagram illustrating a configuration example of a signal processing apparatus in Embodiment 1.
Figure 2:
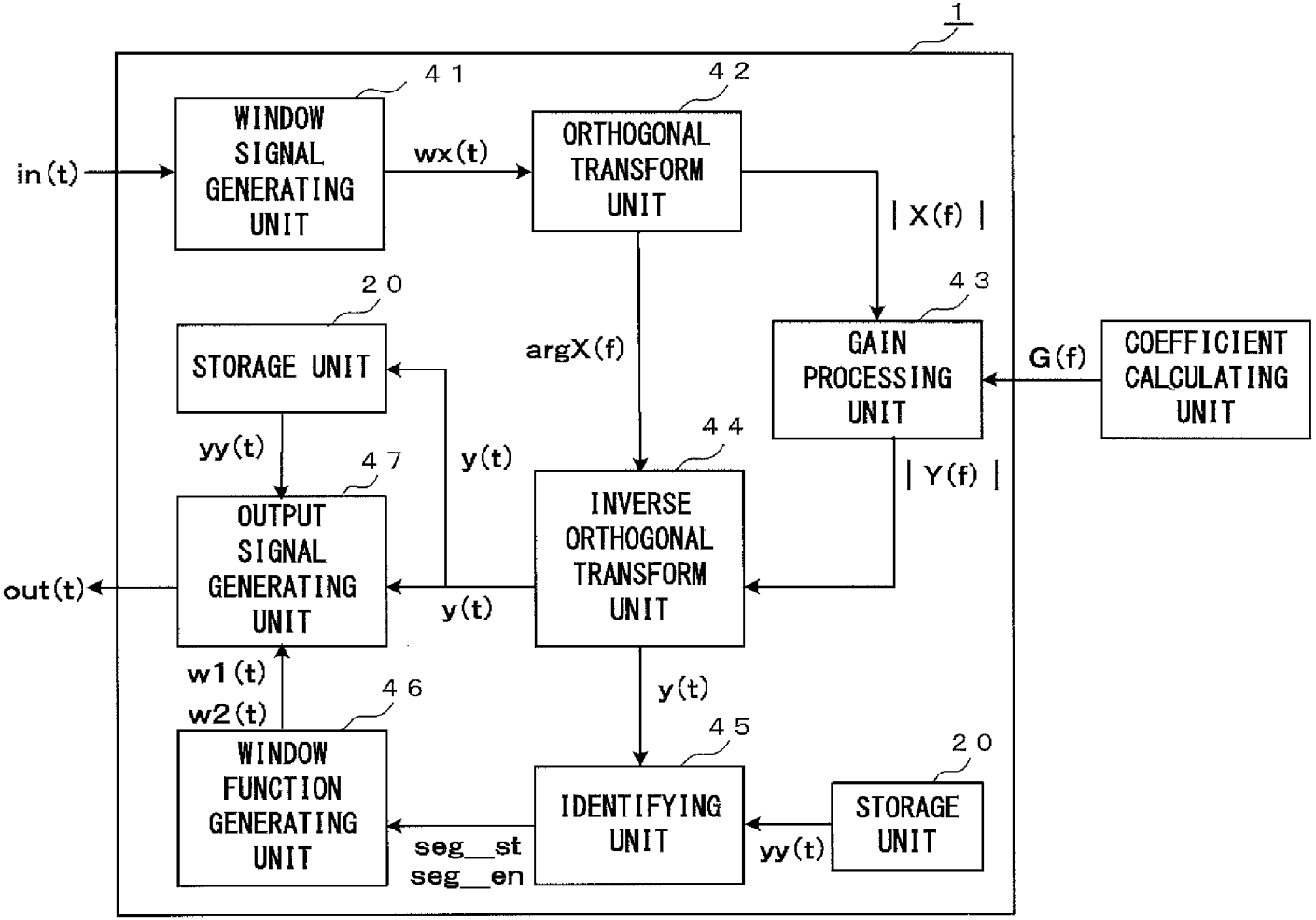
FIG. 2 is a diagram illustrating the flow of the signal in Embodiment 1.

FIG. 1 is a functional block diagram illustrating a configuration example of a signal processing apparatus in Embodiment 1, and FIG. 2 is a diagram illustrating the flow of the signal in Embodiment 1.

A signal processing apparatus 1 in the present Embodiment 1 is a signal processing apparatus that applies noise suppression and the like after transforming an input signal in(t) into the frequency domain and then applies inverse transform into the time domain to output an output signal out(t) and which is configured to be equipped with an input unit 10, a storage unit 20, an output unit 30, and a control unit 40, as illustrated in FIG. 1.

The input unit 10 is constituted by an audio interface or an audio communication module or the like, for example, and receives an input signal in(t) that is the processing target. Then, the input unit 10 outputs the received input signal in(t) to a window signal generating unit 41 that is described in detail later.

The storage unit 20 is constituted by a RAM ((Random Access Memory) a ROM (Read Only Memory), or the like. The storage unit 20 functions as a work area for the CPU (Central. Processing Unit) for example that constitutes the control unit 40, and as a program area for storing various programs such as an operation program for controlling the entirety of the signal processing apparatus 1. In addition, the storage unit 20 functions as a data area for storing various data such as functions such as a window function w(t) that is described in detail later and a frame signal y(t) generated by an inverse orthogonal transform unit 44 that is described in detail later.

The output unit 30 is constituted by an audio interface or an audio communication module or the like, for example, and, outputs an output signal out(t) after signal processing, that is generated by an output signal generating unit 47 that is described in detail later.

The control unit 40 is constituted by a CPU or the like, for example, and executes an operation program stored in the program area of the storage unit 20 to realize functions of the window signal generating unit 41, a counter 41A, an orthogonal transform unit 42, a gain processing unit. 43, the inverse orthogonal transform unit 44, an identifying unit 45, a window function generating unit 46, and the output signal generating unit 47 as illustrated in FIG. 1, and also executes processes such as a control process for controlling the entirety of the signal processing apparatus 1 and signal processing that is described in detail later.

The window signal generating unit 41 divides into frames an input signal in(t) that has been input, and generates a window signal wx(t) for each frame. Then, the window signal generating unit 41 sequentially outputs the generated window signal wx(t) to the orthogonal transform unit 42.

More specifically, the window signal generating unit 41 divides into frames an input signal in(t) that has been input, and generates a frame input signal x(t) that is the input, signal divided into frames and is represented in Formula 1 below. Meanwhile, the frame input signal x(t) represented in Formula 1 is a frame input signal x(t) corresponding to the n-th (n is a natural number that is 1 or greater) frame. In addition, "L" in the formula is the shift length, and assuming "N" as the frame length, $0 \le t \le N$ holds true about t.

[Formula 1]

$$x(t)=\mathrm{in}(t)\times w(t) \tag{1}$$

Then, the window signal generating unit 41 obtains the window function w(t) stored in the storage unit 20, and multiplies the obtained window function w(t) by the frame input signal x(t) corresponding to the processing-target frame, so as to generate the window signal wx(t) represented in Formula 2 below.

[Formula 2]

$$wx(t)=x(t)\times w(t) \tag{2}$$

Here, the window function w(t) is a window function that is set so as to make the amplitudes of both ends of each frame input signal x(t) "0" so that the sum of the contributions of each in the overlap segment of the frame input signals x(t) is always "1", for example, although this is not a limitation.

The counter 41A is a counter for managing processing-target frames, and it is controlled by the window signal generating unit 41. "Counter value k of the counter. 41A"="Frame number n", and the initial value of the counter 41A is "1".

The orthogonal transform unit 42 transforms the window signal wx(t) that has been input, using an orthogonal transform such as MDCT (Modified Discrete Cosine Transform), FFT (Fast Fourier Transform), wavelet transform, or the like, so as to generate an input spectrum X(f) in the frequency domain composed of an amplitude component |X(f)| and a phase component argX(f). Then, the orthogonal transform unit 42 outputs the amplitude component |X(f)| of the generated, input spectrum X(f) to the gain processing unit 43, and also outputs the phase component argX(f) to the inverse orthogonal transform unit 44, as illustrated in FIG. 2.

The gain processing unit 43 multiplies the amplitude component |X(f)| of the input spectrum X(f) that has been input by a coefficient G(f), so as to calculate the amplitude component |Y(f)| after suppression (or amplification represented in Formula 3 below. Then, the gain processing unit 43 outputs the calculated amplitude component |Y(f)| after suppression (or amplification) to the inverse orthogonal transform unit 44, as illustrated in FIG. 2. Meanwhile, the coefficient G(f) is a coefficient for noise suppression and the like, and in Embodiment 1, it is assumed to be supplied from outside the signal processing apparatus 1.

[Formula 3]

$$|Y(f)|=G(f)\times|X(f)| \tag{3}$$

The inverse orthogonal transform unit 44 applies inverse orthogonal transform to the phase component argX(f) of the input spectrum X(f) and the input amplitude component |Y(f)| after suppression (or amplification), so as to generate a frame signal y(t) in the time domain. Then, the inverse orthogonal transform unit 44 stores the generated frame signal y(t) in the data area of the storage unit 20, and also outputs the generated frame signal y(t) to the identifying unit 45 and the output signal generating unit 47 respectively, as illustrated in FIG. 2.

The identifying unit 45 identifies a segment in which the frame signal y(t) (hereinafter expressed as yy(t) in order to distinguish it from the frame signal y(t) corresponding to the current frame) corresponding to the immediately preceding frame is overlapped (hereinafter, referred to as an overlap segment). Then, the identifying unit 45 outputs the starting end seg_st and the terminal end seg_en of the identified overlap segment to the window function generating unit 46, as illustrated in FIG. 2.

Here, an identification method (hereinafter, referred to as the first identification method) for the overlap segment in Embodiment 1 is explained in detail.

The identifying unit 45 identifies a "t" at which the absolute value of the amplitude |y(t)| of the input frame signal y(t) becomes the minimum in the section overlapping with the immediately preceding frame as the starting end seg_st of the overlap segment. At this time, when there are a plurality of "t"s at which the absolute value of the amplitude |y(t)| becomes the minimum, the identifying unit 45 identifies the smallest t among the "t"s at which the absolute value of the amplitude y(t) becomes the minimum in the section overlapping with the immediately preceding frame as the starting end seg_st of the overlap segment.

Meanwhile, the identifying unit 45 obtains the frame signal yy(t) corresponding to the immediately preceding frame from the data area of the storage unit 20. Then, the identifying unit 45 identifies a "t" at Which the absolute value of the amplitude |yy(t)| of the obtained frame signal yy(t) becomes the minimum as the terminal end seg_en of the overlap segment. At this time, when there are a plurality of "t"s at which the absolute value of the amplitude |yy(t)| becomes the minimum, the identifying unit 45 identifies the largest t among the "t"s at which the absolute value of the amplitude |yy(t)| becomes the minimum in the section overlapping with the immediately preceding frame as the terminal end seg_en of the overlap segment.

When the starting end seg_st and the terminal end seg_en identified as described above do not satisfy seg_st<seg_en, the identifying unit 45 adjusts the starting end seg_st and/or the terminal end seg_en so as to satisfy seg_st<seg_en. More specifically, the identifying unit 45 identifies again t at which the absolute value of the amplitude |y(t)| and the absolute value of the amplitude |yy(t)| become the minimum as the starting end seg_st and the terminal end seg_en respectively, within the range in which seg_st<seg_en is satisfied.

As described above, in the first identification method, the overlap segment with which a segment length T becomes the maximum in the overlap segment that satisfies a prescribed condition is identified.

The window function generating unit 46 calculates the length (hereinafter, referred to as the segment length) T of the overlap segment identified by the identifying unit 45, based on the starting end seg_st and the terminal end seg_en that have been input. The segment length T may be expressed as in Formula 4 using the starting end seg_st and the terminal end seg_en of the overlap segment.

[Formula 4]

$$T=\text{seg_en}-\text{seg_}s \tag{4}$$

Then, the window function (generating unit 46 generates an output window function w1(t) and an output, window function w2(t) based on the calculated segment length T and according to Formula 5 and Formula 6 below. Then, the window function generating unit 46 outputs the generated output window function w1(t) and the output window function w2(t) to the output signal generating unit 47, as illustrated in FIG. 2. Meanwhile, seg_st≤t≤seg_en holds true about t.

[Formula 5]

$$w1(t)=0.5-0.5\cos(\pi(t-\text{seg_set})/T) \tag{5}$$

[Formula 5]

$$w2(t)=1.0-w1(t) \tag{6}$$

Here, the output window functions exemplified in Formula 5 and Formula 6 are a window function based on the Hann window function. However, it may also be another window function as long as it is a window function that is set so as to make the amplitude |y(t)| at the starting seg_st of the identified overlap segment "0" and the amplitude |yy(t)| at the terminal end seg_en "0", at least so that the sum of the contributions of each other at both ends of the overlap segment becomes "1".

For example, the window function generating unit 46 may generate the window function represented in Formula 7 below as the output window function w1(t). Meanwhile, the calculation formula for the output window function w2(t) in this case is the same as Formula 6 mentioned above.

(Formula 7)

$$w1(t)=(t-\text{seg_st})/T \tag{7}$$

The output signal generating unit 47 generates the output signal out(t) of the processing-target frame, and outputs the generated output signal out(t) to the output unit 30. More specifically, the output signal generating unit 47 adds and compounds a window signal generated by obtaining the frame signal yy(t) corresponding to the immediately preceding frame from the data area of the storage unit 20 and multiplying the obtained frame signal yy(t) by the output window function w2(t) that has been input, and a window signal generated by multiplying the frame signal y(t) of the current frame by the input output window function w1(t) that has been input, so as to generate the output signal represented in Formula 8 below, in the overlap segment identified by the identifying unit 45.

[Formula 8]

$$\text{out}(t)=w1(t)\times y(t)+w2(t)\times yy(t) \tag{8}$$

Meanwhile, the output signal generating unit 47 sets the frame signal yy(t) corresponding to the immediately preceding frame as the output signal out(t) in the segment before the starting end seg_st in the section overlapping with the immediately preceding frame, and sets the frame signal y(t) corresponding to the current frame as the output signal out(t) in the segment after the terminal end seg_en in the section overlapping with the immediately preceding frame.

Figure 3:
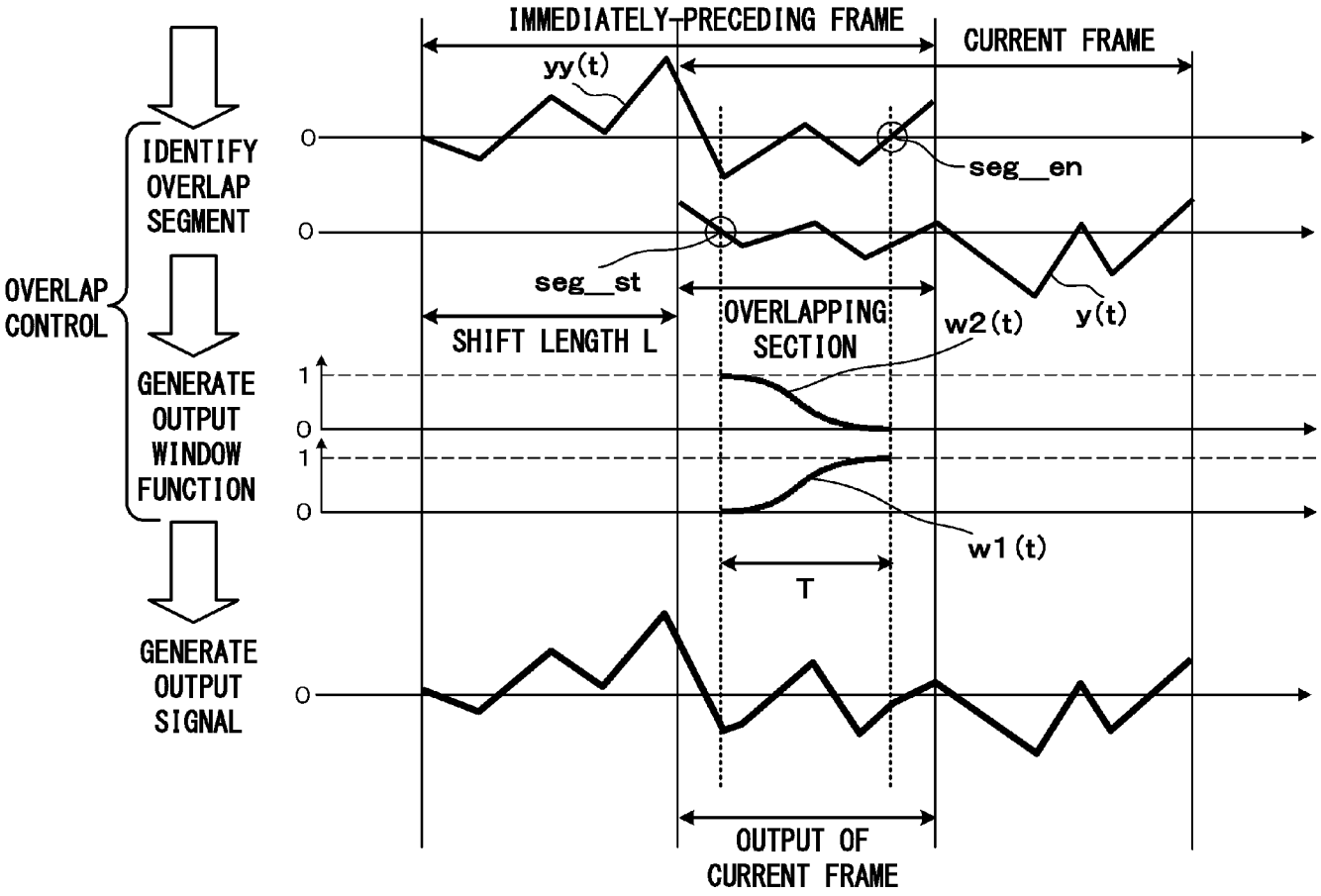
FIG. 3 is a diagram illustrating the flow from identification of an overlap segment based on a first identification method to generation of an output signal, along with a specific example.

Here, referring to FIG. 3, along with a specific example, the flow from identification of the overlap segment based on the first identification method to generation of the output signal out(t) is explained. FIG. 3 is a diagram explaining the flow from identification of the overlap segment based on the first identification method to generation of the output signal out(t), along with a specific example.

First, the identifying unit 45 identifies the overlap segment. In this specific example, as illustrated in FIG. 3, in the section overlapping with the immediately preceding frame, the minimum value of the absolute value of the amplitude |y(t)| of the frame signal y(t) corresponding to the current frame is "0". Therefore, the identifying unit 45 identifies the smallest t in the "t"s at which amplitude |y(t)|=0, in the section overlapping with the immediately preceding frame.

Meanwhile, in this specific example, as illustrated in FIG. 3, in the section overlapping with the current frame, the minimum value of the absolute value of the amplitude |yy(t)| of the frame signal yy(t) corresponding to the immediately preceding frame is "0". Therefore, the identifying unit 45 identifies the largest t in the "t"s at which amplitude |yy(t)|=0, in the section overlapping with the immediately preceding frame.

In this specific example, the starting end seg at and the terminal end seg_en of the overlap segment identified as described above satisfy seg_st<seg_en, as illustrated in FIG. 3.

Then, the window function generating unit 46 generates the output window function w1(t) and the output window function w2(t) whose window length is equal to the segment length T of the overlap segment, respectively. Then, in the identified overlap segment, the output signal generating unit 47 generates the output signal out(t) according to Formula 8.

Figure 4:
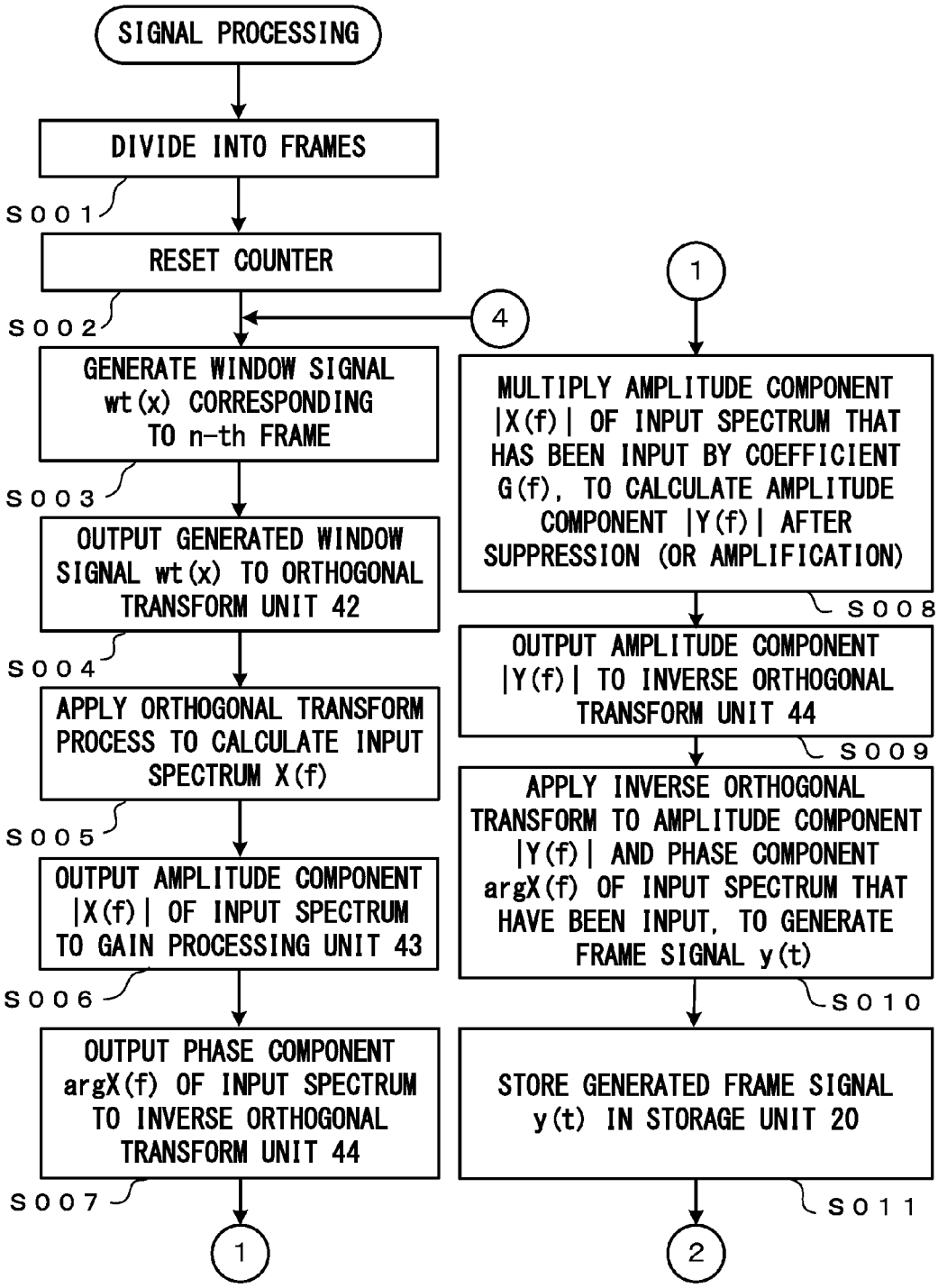
FIG. 4 is the first part of an example of a flowchart for explaining the flow of signal processing in Embodiment 1.
Figure 5:
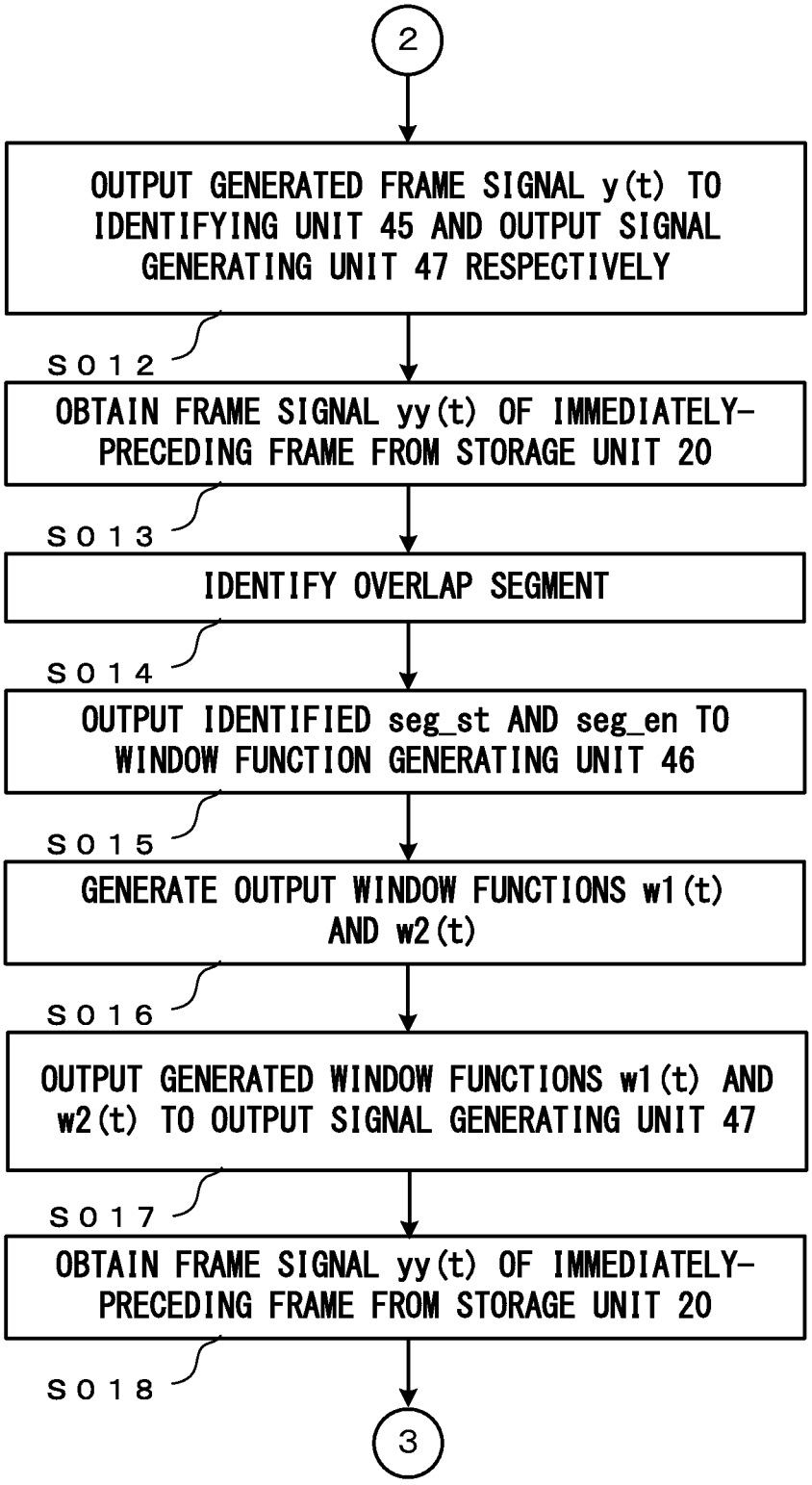
FIG. 5 is the second part of an example of a flowchart for explaining the flow of signal processing in Embodiment 1.
Figure 6:
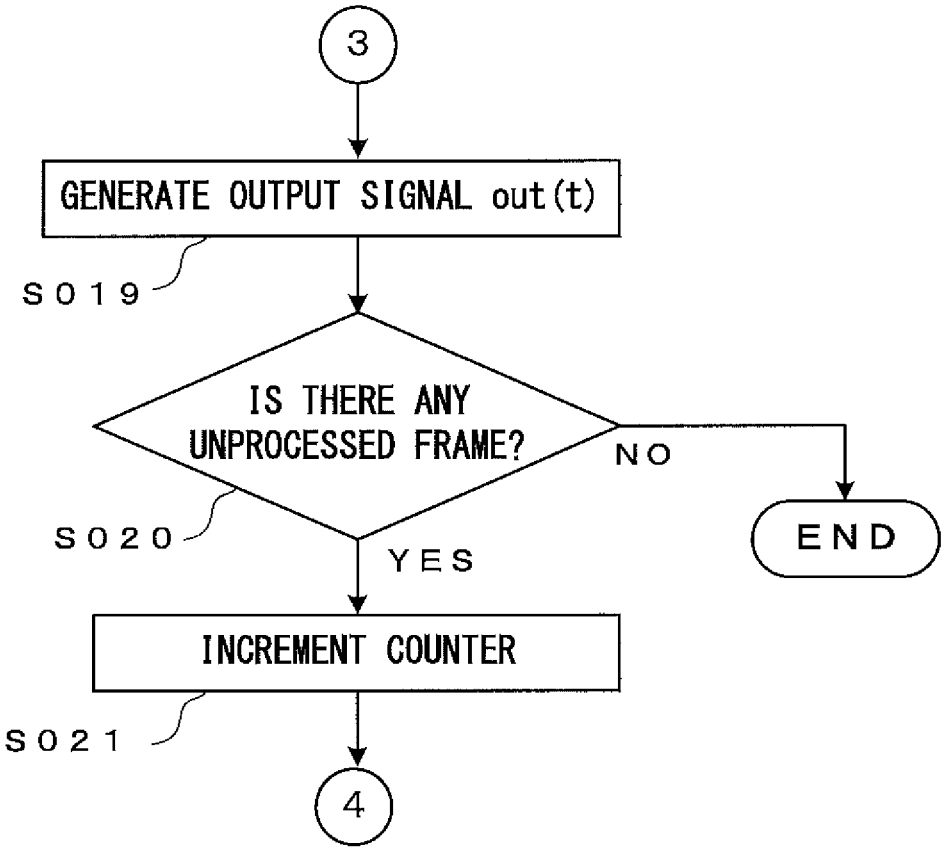
FIG. 6 is the third part of an example of a flowchart for explaining the flow of signal processing in Embodiment 1.

Next, with reference to FIG. 4 through FIG. 6, the flow of signal processing in Embodiment 1 is explained. FIG. 4, FIG. 5, and FIG. 6 are the first part, the second part, and the third part, respectively, of a flowchart for explaining the flow of signal processing in Embodiment 1. This signal processing starts with an input of the input signal in(t) into the window signal generating unit 41 as a trigger, for example.

The window signal generating unit 41 divides the input signal in(t) into frames to generate the input frame signal x(t) (step S001) and also resets the counter 41A (step S002).

Then the window signal generating unit 41 generates the window signal wx(t) of the n-th frame corresponding to the counter value k=n of the counter 41A (step S003) and outputs the generated window signal wx(t) to the orthogonal transform unit 42 (step S004).

Then, the orthogonal transform unit 42 applies orthogonal transform to the window signal wx(t) that has been input to calculate the input spectrum X(f) in the frequency domain (step S005). Then, the orthogonal transform unit 42 outputs the amplitude component |X(f)| of the calculated input spectrum X(f) to the gain processing unit 43 (step S006), and also outputs the phase component argX(f) to the inverse orthogonal transform unit 44 (step S007).

Then, the gain processing unit 43 multiplies the amplitude component |X(f)| that has been input by a coefficient G(f) supplied from outside to calculate the amplitude component |Y(f)| after suppression for amplification) (step S008), and outputs the calculated amplitude component |Y(f)| after suppression (or amplification) to the inverse orthogonal transform unit 44 (step S009).

Then, the inverse orthogonal transform unit 44 applies inverse orthogonal transform to the amplitude component |Y(f)| after suppression (or amplification) and to the phase component argX(f) of the input spectrum X(f) that have been input, so as to generate the frame signal y(t) in the time domain (step S010).

Then, the inverse orthogonal transform unit 44 stores the generated frame signal y(t) in the data area of the storage unit 20 (step S011), and also outputs the generated frame signal y(t) to the identifying unit 45 and the output signal generating unit 47, respectively (step S012).

Then, the identifying unit 45 obtains the frame signal yy(t) corresponding to the immediately preceding frame from the data area of the storage unit 20 (step S013), identifies the starting and seg_st according to the first identification method and based on the frame signal y(t) of the current frame that has been input, and identifies the terminal end sag en based on the obtained frame signal yy(t) of the immediately preceding frame, so as to identify the overlap segment (step S014).

Then, the identifying unit 45 outputs the identified starting end seg_st and the terminal end seg_en to the window function generating unit 46 (step S015).

Then, the window function generating unit 46 calculates the segment length T of the overlap segment based on the starting end seg_st and terminal end seg_st that have been input, and generates the output window function w1(t) and the output window function w2(t), respectively, based on the calculated segment length T (step S106). Then, the window function generating unit 46 outputs the generated output window function w1(t) and the output window function w2(t) to the output signal generating unit 47 (step S017).

Then, the output signal generating unit 47 obtains the frame signal yy(t) corresponding to the immediately preceding frame from the data area of the storage unit 20 (step S018) and in the identified overlap segment, generates the output signal out(t) represented in Formula 8 mentioned above (step S019).

Then, the window signal generating unit 41 judges whether or not there is any unprocessed frame (step S020), and when it is judged by the window signal generating unit 41 that there is no unprocessed frame (step S020; NO), this process is terminated, and waiting for an input of the next input signal in(t) is performed.

On the other hand, when it is judged that there is an unprocessed frame (step S020; YES), the window signal generating unit 41 increments the counter 41A (step S021), this process returns to the process in step S003, and the processes described above are repeated.

According to Embodiment 1 described above, the signal processing apparatus 1 identifies an overlap segment in which the frame signal yy(t) corresponding to the immediately preceding frame overlaps with a section overlapping with the immediately preceding frame, so that at least the absolute value of the amplitude |y(seg_st)| at the starting end seg_st of the overlap segment becomes smaller than the absolute value of the amplitude |y(st)| at the starting end st of the overlapping section, or the absolute value of the amplitude |yy(seg_en)| at the terminal end seg_en of the overlap segment becomes smaller than the absolute value of the amplitude |yy(en)| at the terminal end en of the overlapping section, and in the identified overlap segment, outputs an output signal out(t) obtained by adding and compounding the frame signal yy(t) corresponding to the immediately preceding frame and the frame signal y(t) of the current frame.

By making a configuration as described above, it becomes possible to reduce gaps due to discontinuity at the frame boundary and to suppress noise generated at the frame boundary.

In addition, according to Embodiment 1 described above, the overlap segment is identified so that the segment length becomes the maximum in the overlap segment that satisfies a prescribed condition. By configuring in such a manner, it becomes possible to improve the suppression (or amplification) accuracy.

In addition, according to Embodiment 1 described above, the signal processing apparatus 1 identifies a "t" at which the absolute value of the amplitude |y(t)| becomes the minimum in the section overlapping with the immediately preceding frame as the starting end seg_st of the overlap segment, and identifies a "t" at which the absolute value of the amplitude |yy(t)| becomes the minimum in the section overlapping with the current frame as the terminal end seg_en of the overlap segment. By configuring in such a manner, it becomes possible to minimize gaps due to discontinuity at the frame boundary.

In addition, according to Embodiment 1 described above, the signal processing apparatus 1 generates output window functions w1(t) and w2(t) that are window functions whose window length is equal to the segment length T of the identified overlap segment and that are set so as to make the amplitude |y(seg_st)| at the starting end seg_st of the overlap segment "0" and to make the amplitude |yy(seg_en)| at the terminal end seg_en "0", at least so that the sum of the contributions of each at both ends of the overlap segment becomes "1" and in the identified overlap segment, adds and compounds the window signal obtained by multiplying the frame signal y(t) by the output window function w1(t) and the window signal obtained by multiplying the frame signal yy(t) by the output window function w2(t), so as to generate the output signal out(t) By configuring in such a manner, it becomes possible to eliminate discontinuity at the frame boundary.

Embodiment 2 is described.

In Embodiment 1, the starting end seg_st and the terminal end seg_en of the overlap segment are identified according to the first identification method described above. In Embodiment 2, a case in which the starting end seg_st and the terminal end seg_en of the overlap segment are identified according to a method (hereinafter referred to as the second identification method) that is different from the first identification method is explained.

The basic configuration of the signal processing apparatus 1 in the present Embodiment 2 is the same as that in the case of Embodiment 1. However, the function served by the identifying unit 45 is different from that in the case of Embodiment 1.

The control unit 40 is constituted by a CPU or the like, for example, and executes an operation program stored in the program area of the storage unit. 20 to realize functions of the window signal generating unit 41, the counter 41A, the orthogonal transform unit 42, the gain processing unit 43, the inverse orthogonal transform unit 44, the identifying unit. 45, the window function generating unit 46, and the output signal generating unit 47, as illustrated in FIG. 1, and also executes processes such as a control process for controlling the entirety of the signal processing apparatus 1 and signal processing described in detail later.

The identifying unit 45 identifies the overlap segment, and outputs the identified starting end seg_st and the terminal end seg_en of the overlap segment to the window function generating unit 46, as illustrated in FIG. 2.

Here, the second identification method for the overlap segment in the present Embodiment 2 is explained in detail.

The identifying unit 45 identifies the minimum t among "t"s at which the absolute value of the amplitude |y(t)| of the frame signal y that has been input becomes equal to or smaller than a threshold M (M≥0) that has been set in advance, in the section overlapping with the immediately preceding frame.

Meanwhile, the identifying unit 45 obtains the frame signal yy(t) corresponding to the immediately preceding frame from the data area of the storage unit 20. Then, the identifying unit 45 identifies the maximum t among the "t"s at which the absolute value of the amplitude yy(t) of the obtained frame signal yy(t) becomes equal to or smaller than the threshold M in the section overlapping with the current frame as the terminal end seg_en of the overlap segment.

As described above, in the second identification method, in a similar manner as in the first identification method, an overlap segment at which the segment length T becomes the maximum in an overlap segment that satisfies a prescribed condition is identified.

Figure 7:
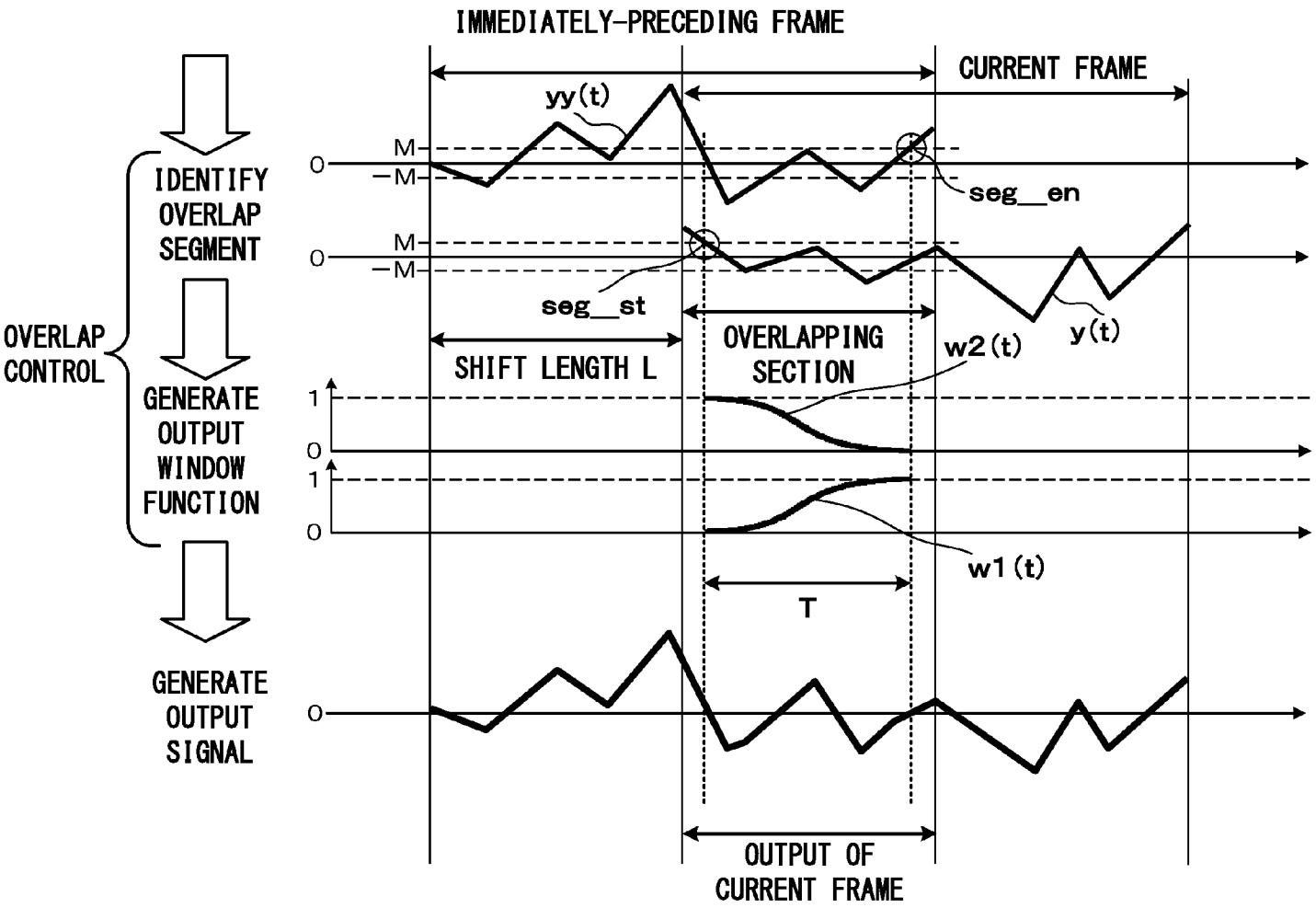
FIG. 7 is a diagram illustrating the flow from identification of an overlap segment based on a second identification method to generation of an output signal, along with a specific example.

Next, referring to FIG. 7, according to a specific example, the flow from identification of the overlap segment based on the second identification method to generation of the output signal out(t) is explained. FIG. 7 is a diagram explaining the flow from identification of the overlap segment based on the second identification method to generation of the output signal out(t), according to a specific example.

First, the identifying unit 45 identifies the overlap segment. In this specific example, in the section overlapping with the immediately preceding frame, the smallest t among "t"s at which the absolute value of the amplitude y(t) of the frame signal y(t) corresponding to the current frame becomes equal to or smaller than the threshold M is the t that is set as the starting end seg_st, as illustrated in FIG. 7.

Meanwhile, in this specific example, in the section overlapping with the current frame, the largest t among "t"s at which the absolute value of the amplitude |yy(t)| of the frame signal yy(t) corresponding to the immediately preceding frame becomes equal to or smaller than the threshold M is the t that is set as the terminal end seg_en, as illustrated in FIG. 7.

Then, the window function generating unit 46 generates the output window function w1(t) and the output window function w2(t) whose window length is equal to the segment length of the overlap segment respectively. Then, the output signal generating unit 47 generates the output signal out(t) according to Formula 8 mentioned above, in the identified overlap segment.

Meanwhile, the configuration may also be made so as to make the threshold M variable according to the amplitudes at both ends of the section overlapping with an adjacent frame. More specifically, assuming the starting end of the overlapping section as st and the terminal end as en, the threshold M is made variable so as to be equal to or smaller than the absolute value of the amplitude that is the smaller of the absolute value of the amplitude |y(st)| of the current frame signal y(t) at the starting end st and the absolute value of the amplitude |yy(en)| of the frame signal yy(t) corresponding to the immediately preceding frame at the terminal end en. By doing this, it becomes possible to reliably suppress gaps due to discontinuity in comparison with the case in which the overlap segment is fixed (overlap segment-overlapping section).

Figure 8:
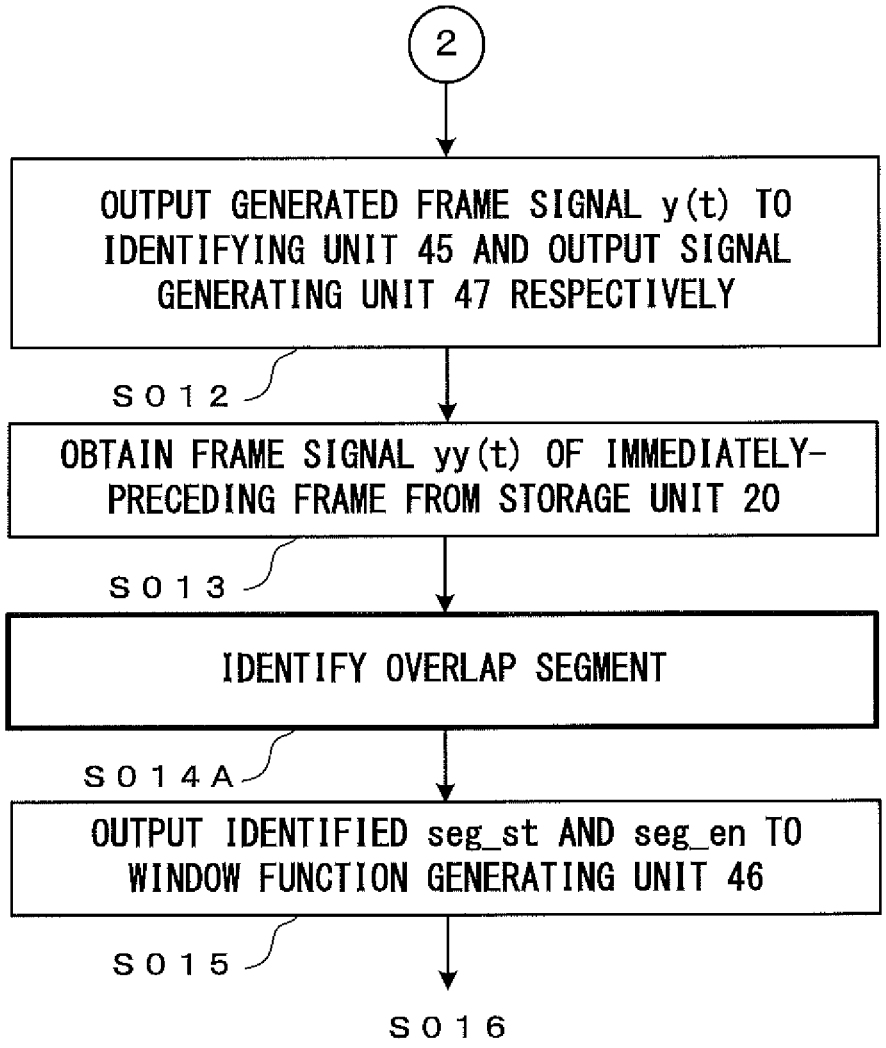
FIG. 8 is a part of an example of a flowchart for explaining the flow of signal processing in Embodiment 2.

Next, referring to FIG. 8, the flow of signal processing in Embodiment 2 is explained. FIG. 8 is part of an example of a flowchart for explaining the flow of signal processing in the present Embodiment 2. This signal processing starts with an input of the input signal in(t) into the window signal generating unit 41 as a trigger, for example. Here, mainly portions that are different from Embodiment 1 are explained.

The identifying unit 45 obtains the frame signal yy(t) corresponding to the immediately preceding frame from the data area of the storage unit 20 (step S013), identifies the starting end seg_st according to the second identification method and based on the input frame signal y(t) of the current frame, and identifies the terminal end seg_en based on the obtained frame signal yy(t) of the immediately preceding frame, so as to identify the overlap segment (S014A).

Then, the identifying unit 45 outputs the identified starting end seg_st and terminal end seg_st to the window function generating unit 46 (step S015). Then, the process proceeds to the process in step S016 explained in Embodiment 1.

According to Embodiment 2 described above, the signal processing apparatus 1 identifies the smallest t among "t"s at which the absolute value of the amplitude: |y(t)| becomes equal to or smaller than the threshold M in the section overlapping with the immediately preceding frame as the starting end of the overlap segment, and identifies the largest t among "t"s at which the absolute value of the amplitude |yy(t)| becomes equal to or smaller than the threshold M in the section overlapping with the current frame as the terminal end seg_en of the overlap segment.

By configuring in such a manner, it becomes possible to make the width of the overlap segment larger in comparison with the case in which the overlap segment is identified according to the first identification method explained in Embodiment 1. Accordingly, it becomes possible to improve the suppression (or amplification) accuracy while suppressing gaps due to discontinuity at the frame boundary to within the allowable range.

Embodiment 3 is described.

In Embodiments 1 and 2, the signal processing apparatus 1 is configured so as to generate output window functions, and to suppress generation of discontinuity by making the amplitudes at both ends of the overlap segment "0" by means of the generated output window functions.

In Embodiment 3, the signal processing apparatus 1 is configured so as to make the amplitudes at both ends of the overlap segment "0" by applying a correction process such as addition of a DC component for example, so as to suppress generation of discontinuity. Meanwhile, this configuration may also be applied to the overlap segment identified according to both the first identification method and the second identification explained in Embodiments 1 and 2. In the present Embodiment 3, a case in which it is applied to the overlap segment identified according to the second identification method is explained.

Figure 9:
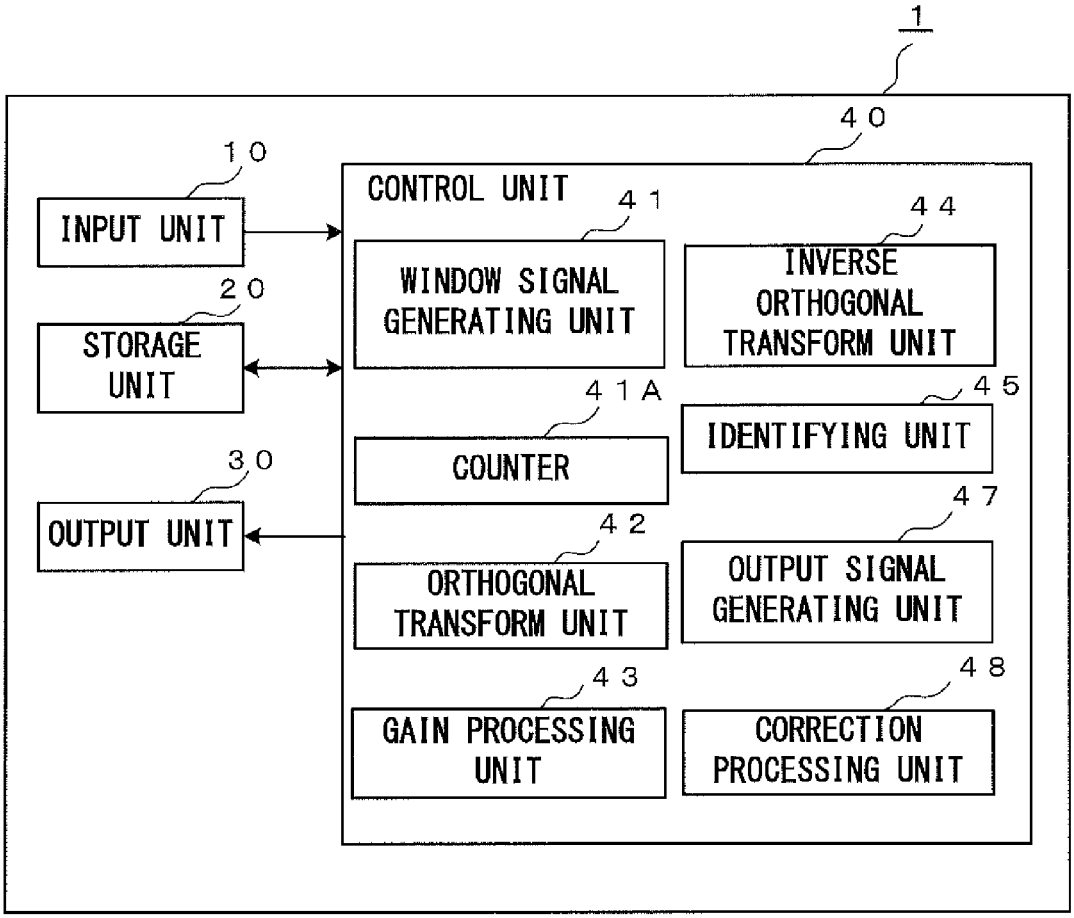
FIG. 9 is a functional block diagram illustrating a configuration example of a signal processing apparatus in Embodiment 3.
Figure 10:
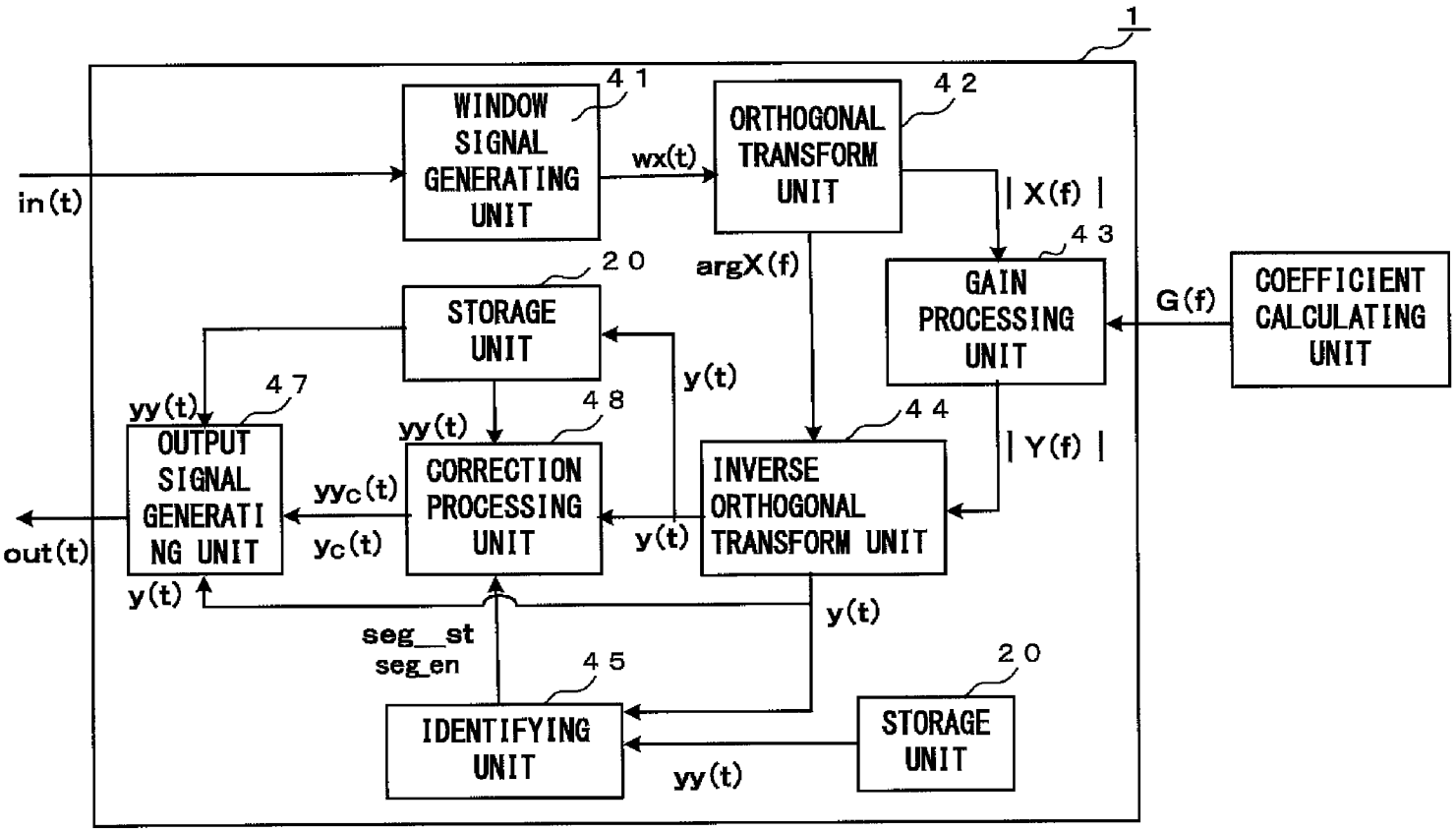
FIG. 10 is a diagram illustrating the flow of the signal in Embodiment 3.

FIG. 9 is a functional block diagram illustrating a configuration example of the signal processing apparatus 1 in Embodiment 3. FIG. 10 is a diagram illustrating the flow of the signal in the present Embodiment 3. The basic configuration of the signal processing apparatus 1 in the present Embodiment 3 is the same as that in the case of Embodiment 1.

However, as illustrated in FIG. 9, there is a difference from the case in Embodiment 1 in that the control unit 40 is not equipped with the window function generating unit 46 and is further equipped with a correction processing unit 48. In addition, the functions served by the inverse orthogonal transform unit 44, the identifying unit 45 and the output signal generating unit 47 are respectively different from those in the case of Embodiment 1.

The control unit 40 is constituted by a CPU and the like, for example, and executes an operation program stored in the program area of the storage unit 20 to realize functions of the window signal generating unit 41, the counter 41A, the orthogonal transform unit 42, the gain processing unit 43, the inverse orthogonal transform unit 44, the identifying unit 45, the output signal generating unit 47 and the correction processing unit 48, and also executes a control process for controlling the entirety of the signal processing apparatus 1 and signal processing described in detail later.

The inverse orthogonal transform unit 44 applies inverse orthogonal transform to the phase component argX(f) of the input spectrum X(f) and the amplitude component |Y(f)| after suppression (or amplification) that have been input, so as to generate the frame signal y(t) in the time domain. Then, the inverse orthogonal transform unit 44 stores the generated frame signal y(t) in the data area of the storage unit 20, and also outputs the generated frame signal y(t) to the identifying unit 45 and the output signal generating unit 47 and the correction processing unit 46, respectively, as illustrated in FIG. 10.

The identifying unit 45 identifies the overlap segment according to the second identification method described above. Then, the identifying unit 45 outputs the starting end seg_st and the terminal end seg_en of the identified overlap segment to the correction processing unit 48, as illustrated in FIG. 10.

The output signal generating unit 47 generates the output signal out(t) of the processing-target frame, and outputs the generated output signal out(t) to the output unit 30. More specifically, in the overlap segment identified by the identifying unit 45, the output signal generating unit 47 adds and compounds frame signals $y_c(t)$ and $yy_c(t)$ alter correction input from the correction processing unit 48 so as to generate the output signal out (t) represented in Formula 9 below.

[Formula 9]

$$\mathrm{out}(t)=yy_c(t)+y_c(t) \tag{9}$$

The correction processing unit 48 generates a signal for correction C1(t) to correct the amplitude |y(seg_st)| of the frame signal y(t) of the current frame at the starting end seg_st to be "0" and a signal for correction C2(t) to correct the amplitude |yy(seg_en)| of the frame signal yy(t) corresponding to the immediately preceding frame at the terminal end seg_en to be "0" Then, the correction processing unit 48 generates frame signals $y_c(t)$ and $yy_c(t)$ after correction that have been corrected based on the signals for correction. Then, the correction processing unit 48 outputs the generated frame signals $y_c(t)$ and $yy_c(t)$ after correction to the output signal generating unit 47 as illustrated in FIG. 10.

More specifically, the correction processing unit 48 generates the signal for correction C1(t) based on the amplitude |y(seg_st)| of the frame signal y(t) of the current frame at the starting end seg_st that has been input. For example, the correction processing unit 4$ generates the signal for correction C1(t) represented in Formula 10, for example.

[Formula 10]

$$C1(t)=-y(\mathrm{seg_st}) \tag{10}$$

In a similar manner, the correction processing unit 48 obtains the frame signal yy(t) corresponding to the immediately preceding frame stored in the data area of the storage unit 20, and generates the signal for correction C2(t) based on the amplitude |yy(seg_en)| of the frame signal yy(t) corresponding to the immediately preceding frame at the terminal end seg_en that has been input. For example, the correction processing unit 48 generates the signal for correction C2(t) represented in Formula 11 below.

[Formula 11]

$$C2(t)=-yy(\mathrm{seg_en}) \tag{11}$$

Then, the correction processing unit 48 adds and compounds the frame signal y(t) and the signal for correction C1(t), so as to generate the frame signal $y_c(t)$ after correction represented in Formula 12 below. The amplitude $|y_c(\mathrm{seg_st})|$ of the frame signal $y_c(t)$ after correction generated as described above at the starting end seg_st is "0".

[Formula 12]

$$y_c(t)=y(t)+C1(t) \tag{12}$$

In a similar manner, the correction processing unit 48 adds and compounds the frame signal yy(t) and the signal for correction C2(t), so as to generate the frame signal $yy_c(t)$ after correction that is represented in Formula 13 below. The amplitude $|yy_c(\mathrm{seg_en})|$ of the frame signal $yy_c(t)$ after correction generated as described above at the terminal end seg_en is "0".

[Formula 13]

$$yy_c(t)=yy(t)+C2(t) \tag{13}$$

Meanwhile, the signal for correction C1(t) (or C2(t)) generated by the correction processing unit 48 may be another signal as long as the amplitude |y(seg_st)| and the amplitude |yy(seg_en)| can be corrected to be "0", but a signal for correction that minimizes generation of distortion in the frame signal $y_c(t)$ (or $yy_c(t)$) is preferable. This is because distortion in the frame signal, especially in the high-frequency band, causes deterioration in the sound quality.

Figure 11:
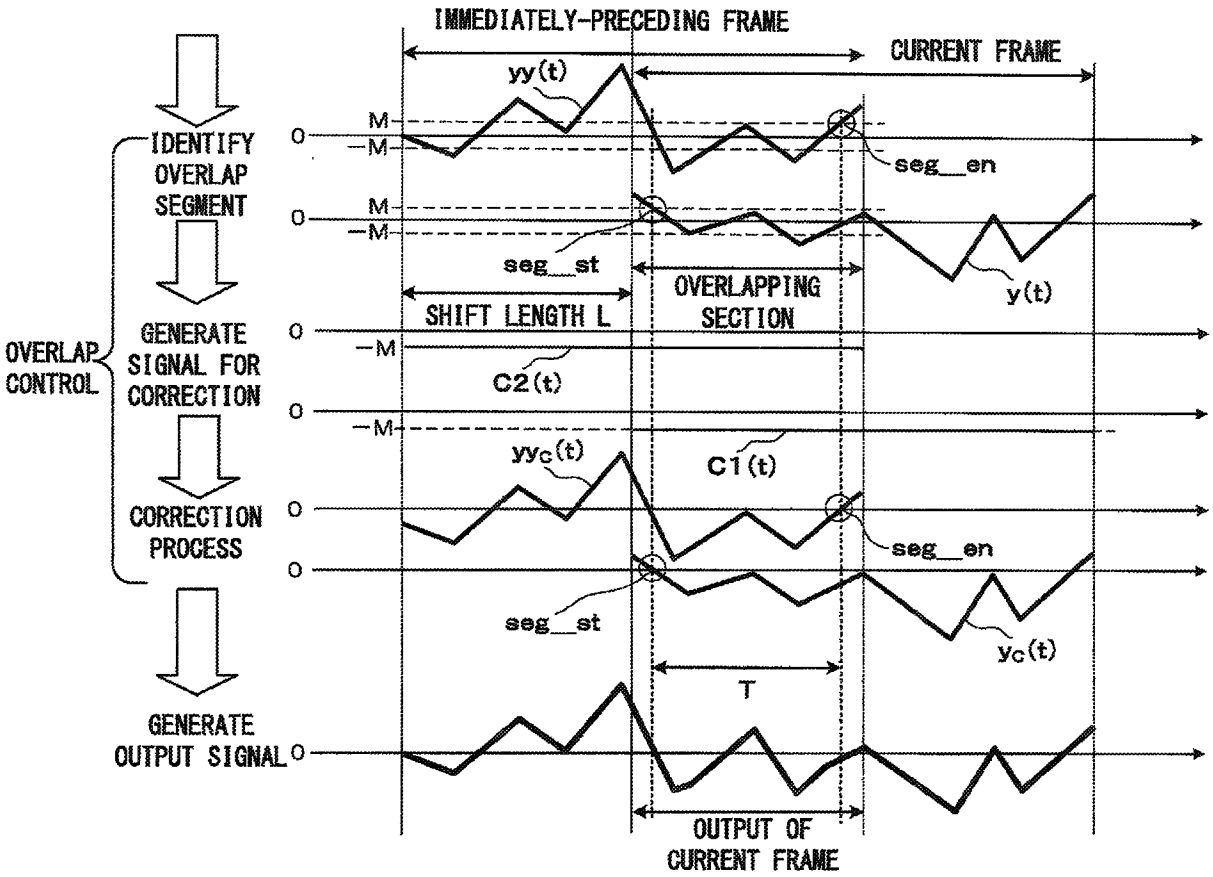
FIG. 11 is a diagram illustrating the flow from identification of an overlap segment based on a second identification method to generation of an output signal, along with a specific example.

Next, referring to FIG. 11, according to a specific example, the flow from identification of the overlap segment based on the second identification method to generation of the output signal out(t) is explained. FIG. 11 is a diagram explaining the flow from identification of the overlap segment based on the second identification method to generation of the output signal out(t) according to a specific example.

First, the identifying unit 45 identifies the overlap segment. In this specific example, as illustrated in FIG. 11, the smallest t among the "t"s at which the absolute value of the amplitude |y(t)| of the frame signal y(t) corresponding to the current frame becomes equal to or smaller than the threshold M in the section overlapping with the immediately preceding frame is the t that is set as the starting end seg_st.

Meanwhile, in this specific example, as illustrated in FIG. 11, the largest t among "t"s at which the absolute value of the amplitude |yy(t)| of the frame signal yy(t) corresponding to the immediately preceding frame becomes equal to or smaller than M in the section overlapping with the current frame is the t that is set as the terminal end seg_en.

In this specific example, the amplitudes |y(seg_st)| and |yy(segd_en)| at both ends of the overlap segment are both M, as illustrated in FIG. 11. Therefore, the correction processing unit 48 generates a signal for correction C1(t) (=−M) for the frame signal y(t) corresponding to the current frame and a signal for correction C2(t)(=−M) for the frame signal yy(t) corresponding to the immediately preceding frame.

Then, the correction processing unit 48 adds and compounds the signal for correction C1(t) and the frame signal y(t) of the current frame, so as to generate a frame signal $y_c(t)$ after correction. In a similar manner, the correction processing unit 48 adds and compounds the signal for correction C2(t) and the frame signal yy(t) corresponding to the immediately preceding frame, so as to generate a frame signal $yy_c(t)$ after correction.

By applying a correction process as described above, as illustrated in FIG. 11, the amplitude $|y_c(seg_st)|$ of the frame signal $y_c(t)$ after correction at the starting end seg_st is corrected to be "0", and in a similar manner, the amplitude $|yy_c(seg_en)|$ of the frame signal $yy_c(t)$ after correction at the terminal end seg_en is corrected to be "0".

Then, in the identified overlap segment, the output signal generating unit 47 generates the output signal out(t) according to Formula 9 mentioned above.

Figure 12:
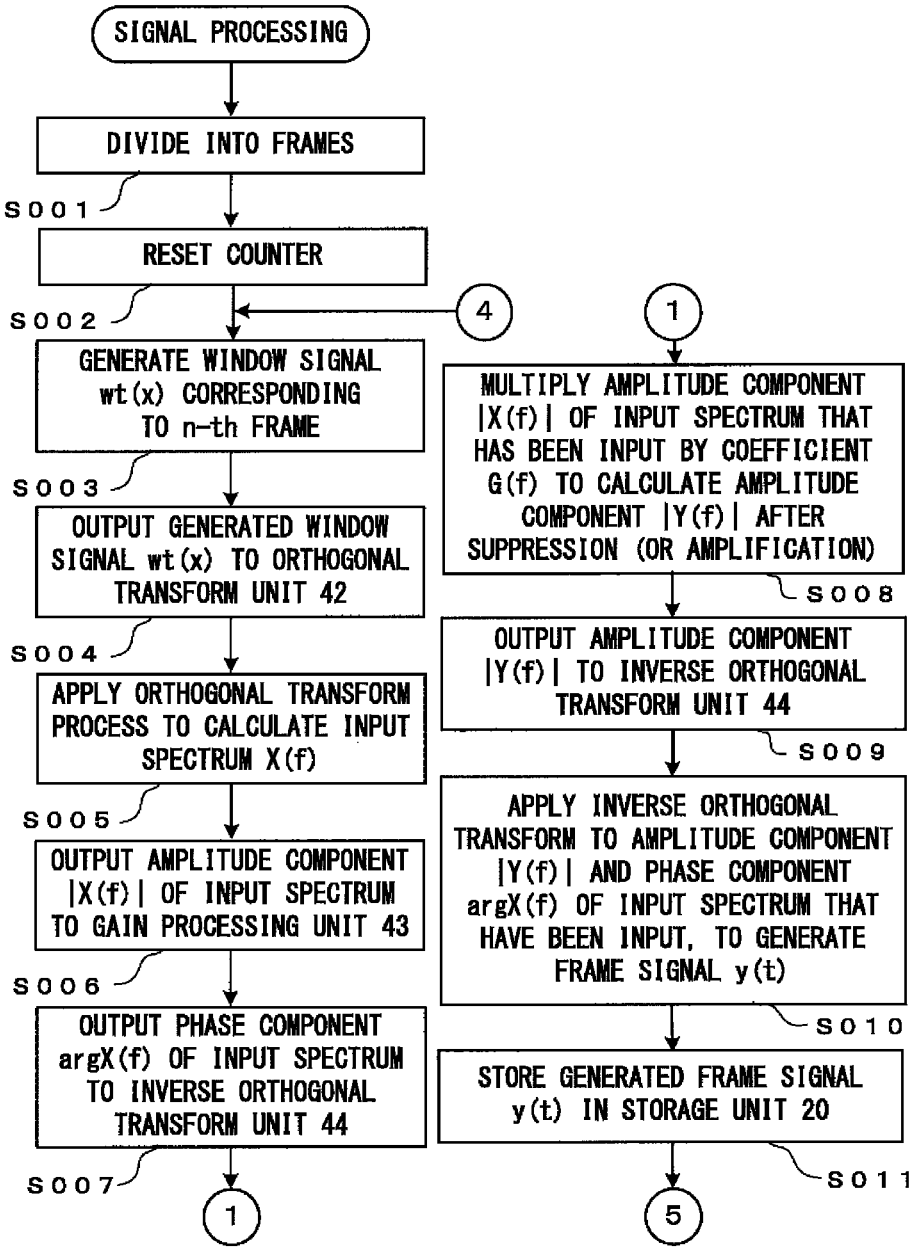
FIG. 12 is the first part of an example of a flowchart for explaining the flow of signal processing in Embodiment 3.
Figure 13:
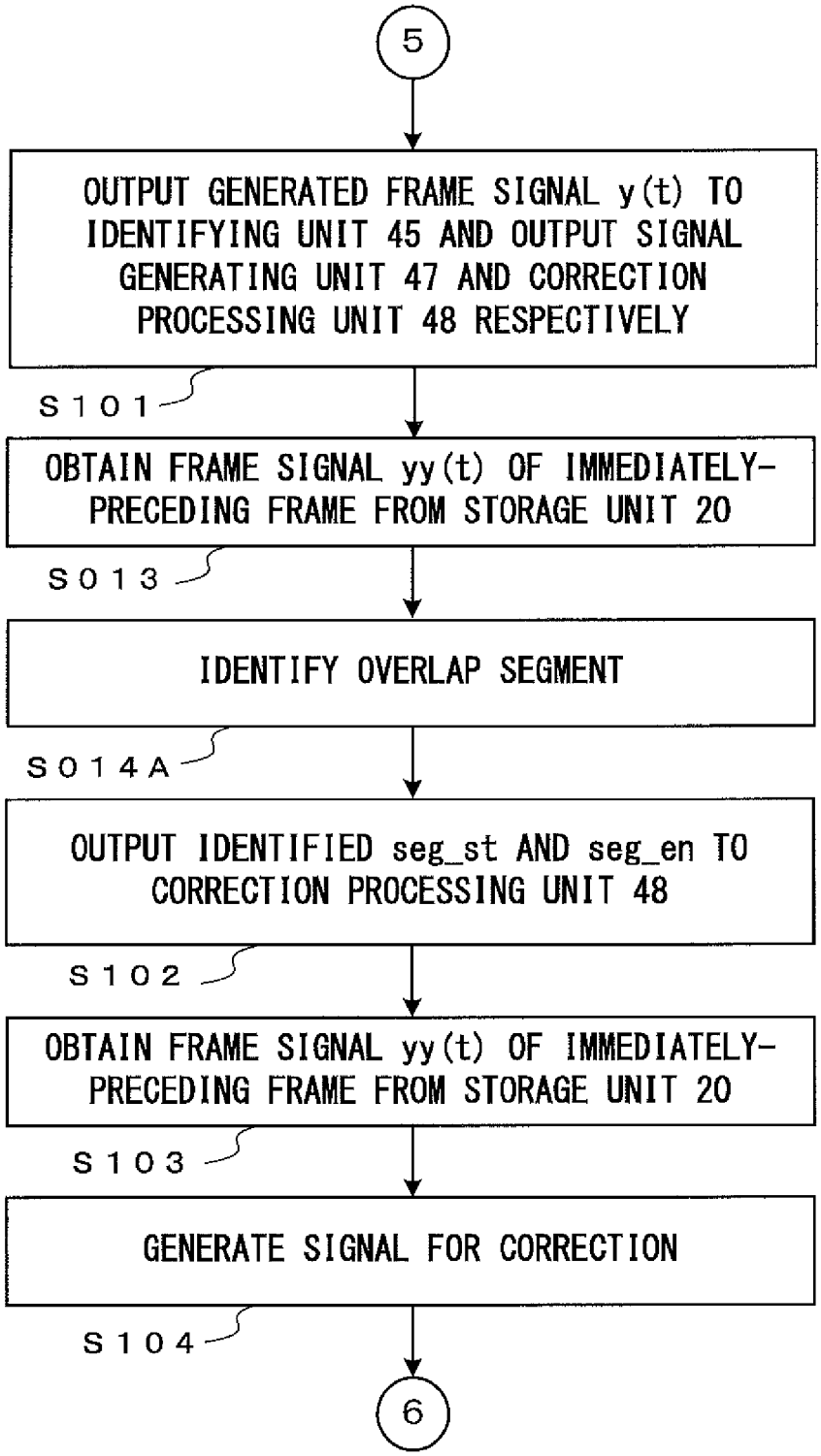
FIG. 13 is the second part of an example of a flowchart for explaining the flow of signal processing in Embodiment 3.
Figure 14:
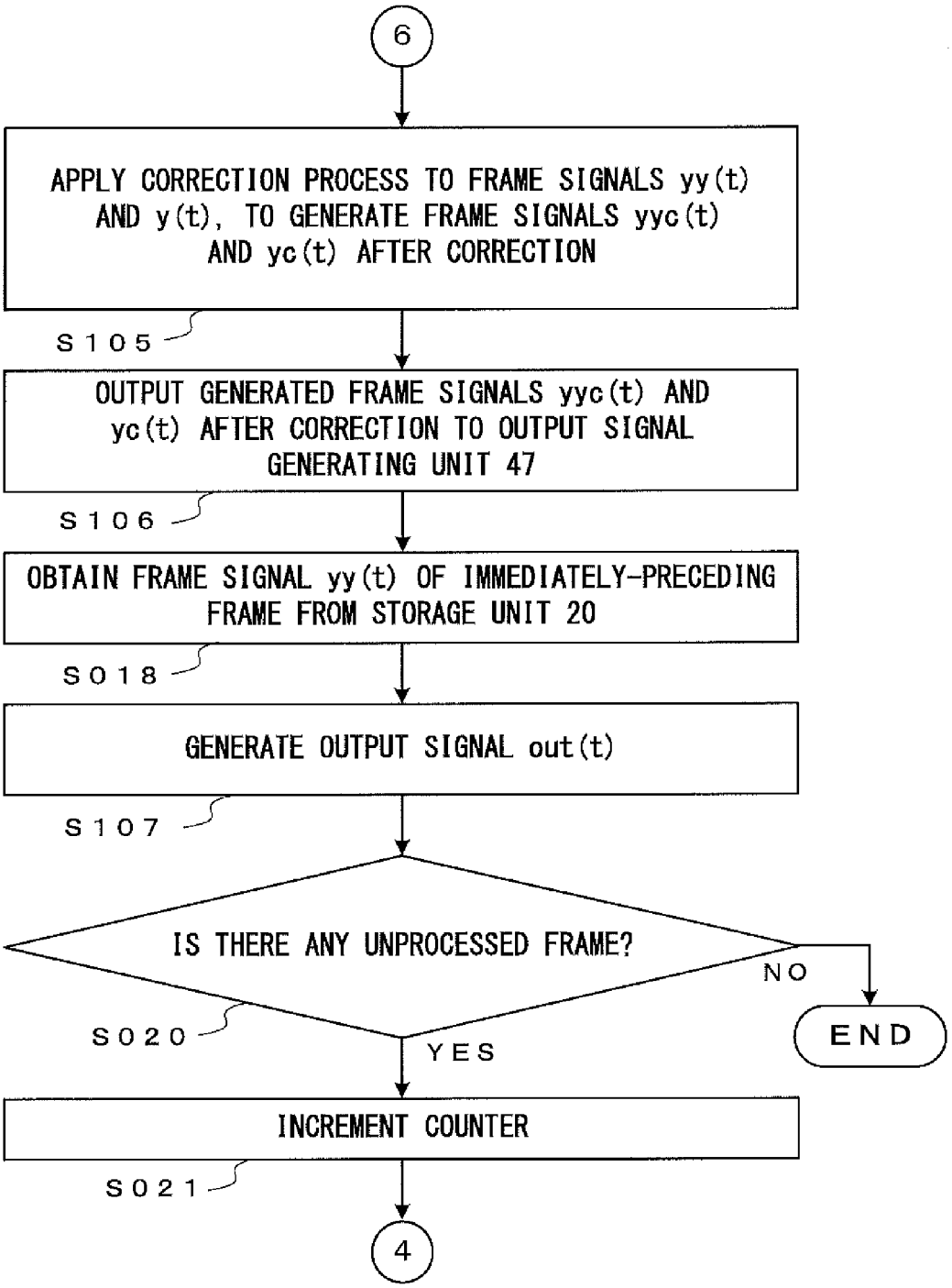
FIG. 14 is the third part of an example of a flowchart for explaining the flow of signal processing in Embodiment 3.

Next, with reference to FIG. 12 through FIG. 14, the flow of signal processing in the present Embodiment 3 is explained. FIG. 12, FIG. 13, and FIG. 14 are the first part, the second part, and the third part, respectively, of an example of a flowchart for explaining signal processing in the present Embodiment 3. This signal processing starts with an input of the input signal in(t) into the window signal generating unit 41 as a trigger, for example.

The window signal generating unit 41 divides into frames the input signal in(t) that has been input, so as to generate an input frame: signal x(t) (step S001), and also resets the counter 41A (step 2002).

Then, the window signal generating unit 41 generates the window signal wx(t) of the n-th frame corresponding to the counter value k=n of the counter 41A (step S003), and outputs the window signal wx(t) to the orthogonal transform unit 42 (step S004).

Then, the orthogonal transform unit 42 applies orthogonal transform to the input window signal wx(t), so as to calculate the input spectrum X (f) in the frequency domain (step S005). Then, the orthogonal transform unit 42 outputs the amplitude component |X(f)| of the calculated input spectrum (f) to the gain processing unit 43 (step S005), and also outputs the phase component argX(f) to the inverse orthogonal transform unit 44 (step S007).

Then, gain processing unit 43 multiplies the amplitude component |X(f)| that has been input by the coefficient G(f) supplied from outside to calculate amplitude component |Y(f)| after suppression (or amplification) (step S008), and outputs the calculated amplitude component |Y(f)| after suppression (or amplification) to the inverse orthogonal transform unit 44 (step S009).

Then, the inverse orthogonal transform unit 44 applies inverse orthogonal transform to the amplitude component |Y(f)| after suppression (or amplification) and to the phase component argX(f) of the input spectrum X(f) that have been input, so as to generate the frame signal y(t) in the time domain (step S010).

Then, the inverse orthogonal transform unit 44 stores the generated frame signal y(t) in the data area of the storage unit 20 (step S011) and also outputs the generated frame signal y(t) to the identifying unit 45, the output signal generating unit 47 and the correction processing unit 48, respectively (step S101).

Then, the identifying unit 45 obtains the frame signal yy(t) corresponding to the immediately preceding frame from the data area of the storage unit 20 (step S013), identifies the starting end seg_st based on the frame signal y(t) of the current frame that has been output, and identifies the terminal end seg_en based on the obtained frame signal yy(t) of the immediately preceding frame, according to the second identification method, so as to identify the overlap segment (step S014A).

Then the identifying unit 45 outputs the identified starting end seg_st and the terminal end seg_st to the correction processing unit 48 (step S102).

Then, the correction processing unit 48 obtains the frame signal yy(t) corresponding to the immediately preceding frame stored in the data area of the storage unit 20 (step S103), Then, the correction processing unit 48 generates the signal for correction C1(t) based on the amplitude |y(seg_st)| of the frame signal y(t) of the current frame at the starting end seg_st that has been input, and in a similar manner, generates the signal for correction C2(t) based on the amplitude |yy(segd_en)| of the frame signal yy(t) corresponding to the immediately preceding frame at the terminal end seg_en that has been input (step S104).

Then, the correction processing unit 48 adds and compounds the frame signal y(t) and the signal for correction C1(t), so as to generate the frame signal $y_c(t)$ after correct ion, and in a similar manner, adds and compounds the frame signal yy(t) and the signal for correction C2(t), so as to generate the frame signal $yy_c(t)$ after correction (step S105). Then, the correction processing unit 48 outputs the generated frame signals y(t) and yy(t) to the output signal generating unit 47 (step S106).

Then, the output signal generating unit 47 obtains the frame signal yy(t) corresponding to the immediately preceding frame from the data area of the storage unit 20 (step S018) and in the identified overlap segment, generates the output signal out(t) represented in Formula 9 mentioned above (step S107).

Then, the window signal generating unit 41 judges whether or not there is any unprocessed frame (step S020), and when it is judged by the window signal generating unit 41 that there is no unprocessed frame (step S020; NO), this process is terminated, and waiting for an input of the next input signal in(t) is performed.

On the other hand, when it is judged that there is an unprocessed frame (step S020; YES), the window signal generating unit 41 increments the counter 41A (step S021), this process returns to the process in step S003, and the processes described above are repeated.

According to Embodiment 3 described above, in the overlap segment, the signal processing apparatus 1 adds and compounds signals for correction that make the amplitudes at the frame boundary (both ends of the overlap segment) after correction "0" and respectively the frame signal y(t) and the frame signal yy(t), so as to generate frame signals $y_c(t)$ and $yy_c(t)$ after correction, and outputs the output signal out(t) obtained by adding and compounding frame signals $y_c(t)$ and $yy_c(t)$ after correction.

By configuring in such a manner, it becomes possible to eliminate discontinuity at the frame boundary. In addition, the absolute values of the amplitudes at both ends of the overlap segment are adjusted to be smaller than the amplitudes at both ends of the overlapping section, and therefore, it becomes possible to make the size of the component (for example a DC component) added to eliminate discontinuity smaller. Accordingly, it becomes possible to suppress noise in playback in the playback device.

In addition, according to Embodiment 3 described above, the signal processing apparatus 3 generates a signal for correction that does not cause a large distortion in the frame signal y(t) (or yy(t)) when added and compounded. By configuring in such a manner, it becomes possible to prevent deterioration in the sound quality.

Embodiment 4 is described.

In Embodiment 4, application examples of the signal processing apparatus 1 described in Embodiments 1 through 3 are explained. Meanwhile, explanation is given below, assuming that the configuration of the signal processing apparatus 1 in the present. Embodiment 4 is the configuration described in Embodiment 1. Apart from the application examples exemplified here, the signal processing apparatus 1 described in Embodiments 1 through 3 may be applied to an apparatus that adopts a frequency-domain suppression/amplification system for performing suppression or amplification) in the frequency domain.

APPLICATION EXAMPLE 1

Figure 15:
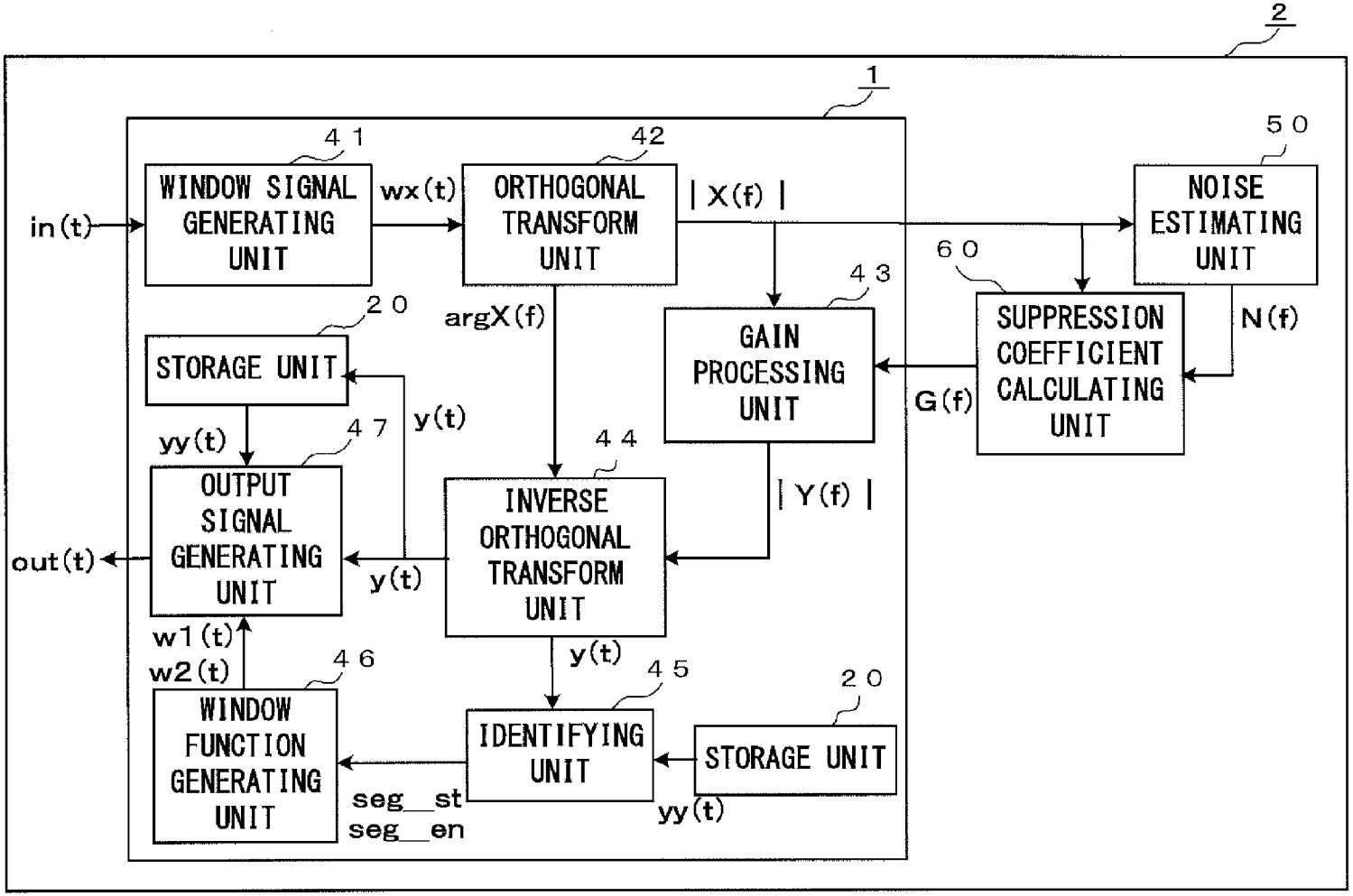
FIG. 15 illustrates a configuration example of a noise suppression apparatus and the flow of the signal in Application example 1.

This Application example 1 is an example in which the signal processing apparatus 3 is applied to a noise suppression apparatus 2. FIG. 15 illustrates a configuration example of the noise suppression apparatus 2 and the flow of the signal in this Application example 1.

The noise suppression apparatus 2 in this Application example 1 performs a noise suppression process as an example of the process in the gain processing unit 43, and as illustrated in FIG. 15, it is configured to include a noise estimating unit 50 and a suppression coefficient calculating unit 60, in addition to the configuration of the signal processing apparatus 1 in Embodiment 1.

The noise estimating unit 50 estimates an estimated noise spectrum N(f) based on the amplitude component |X(f)| output from the orthogonal transform unit 42 of the signal processing apparatus 1. Then, as illustrated in FIG. 15, the noise estimating unit 50 outputs the estimated noise spectrum N(f) to the suppression coefficient calculating unit 60.

More specifically, every time the amplitude component |X(f)| of the input spectrum X(f) is input, the noise estimating unit 50 judges based on the amplitude component |X(f)| whether or not the current frame includes sound, and updates the estimated noise spectrum N(f) when it judges that no sound is included.

That is, the noise estimating unit 50 updates the estimated noise spectrum N(f) according to Formula 14 below, when it is judged that no sound is included in the current frame. Meanwhile, $N_0(f)$ in the formula represents the estimated noise spectrum at the time of processing for the immediately preceding frame, and A is a prescribed constant number.

[Formula 14]

$$N(f)=A\times N_0(f)+(1-A)\times|X(f)| \tag{14}$$

Meanwhile, when it is judged that no sound is included in the current frame, the noise estimating unit 50 sets the estimated noise spectrum N(f) at the time of processing for the immediately preceding frame as the estimated noise spectrum N(f) for the current frame. That is, in this case, the noise estimating unit 50 outputs the estimated noise spectrum N(f) represented in Formula 15 below to the suppression coefficient calculating unit 60.

[Formula 15]

$$N(f)=N_0(f) \tag{15}$$

The suppression coefficient calculating unit 60 calculates a suppression coefficient G(f) based on the noise spectrum N(f) that has been input and the amplitude component |X(f)| output from the orthogonal transform unit 42. Then, the suppression coefficient calculating unit 60 outputs the calculated suppression coefficient G(f) to the gain processing unit 43 of the signal processing apparatus 1, as illustrated in FIG. 15

More specifically the suppression coefficient calculating unit 60 calculates an SNR (Signal-Noise Ratio) according to Formula 16 below. Meanwhile, SNR(f) in the formula is an SNR.

[Formula 16]

$$SNR(f)=|X(f)|/N(f) \tag{16}$$

Then suppression coefficient calculating unit 60 calculates the suppression coefficient G(f) according to the calculated SNR.

As explained in Embodiments 1 through 3, the suppression process in the frequency domain is performed by the gain processing unit 43 based on the suppression coefficient G(f) calculated as described above, and after that, the frame signal y(t) in the time domain is generated by the inverse orthogonal transform unit 44.

When the suppression process is performed using different suppression coefficients G(f) for adjacent frames, there may be a deviation in the amplitudes at both ends of the frame signal y(t), but it becomes possible to correct this deviation according to the method explained in Embodiments 1 through 3 described above.

APPLICATION EXAMPLE 2

Figure 16:
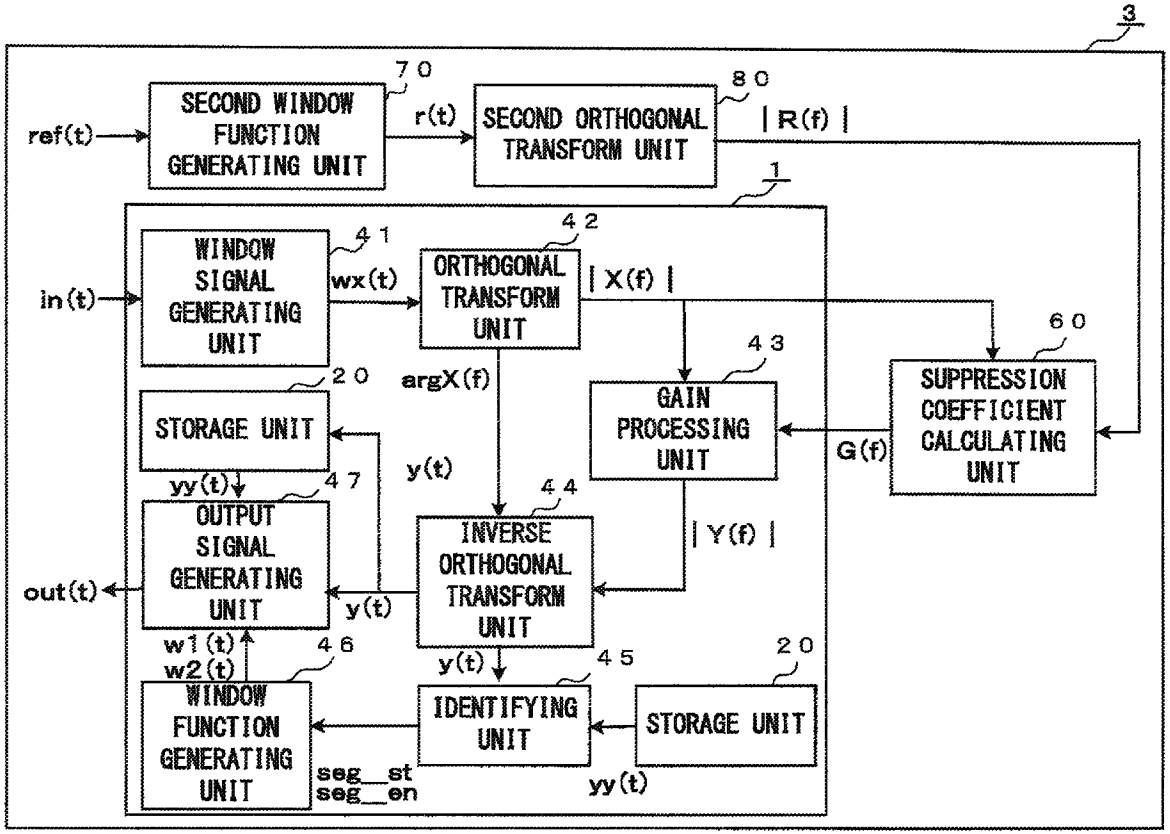
FIG. 16 illustrates a configuration example of a noise suppression apparatus and the flow of the signal in Application example 2.

This Application example 2 is an example in which the signal processing apparatus 1 is applied to an echo suppression apparatus 3. FIG. 16 illustrates a configuration example of the echo suppression apparatus 3 and the flow of the signal in this Application example 2.

The echo suppression apparatus 3 in this Application example 2 performs an echo suppression process as an example of the process in the gain processing unit 43, and it is configured to include the suppression coefficient calculating unit 60, a second window signal generating unit 70, and a second orthogonal transform unit 80, in addition to the configuration of the signal processing apparatus 1 in Embodiment 1.

The second window signal generating unit 70 divides into frames a reference signal ref(t) with respect to an input signal in(t), so as to generate an window signal r(t) for each frame. Then, the second window signal generating unit 70 sequentially outputs the generated window signal r(t) to the second orthogonal transform unit 80, as illustrated in FIG. 16.

More specifically, the second window signal generating unit 70 divides into frames the input reference signal ref(t), so as to generate a frame reference signal rx(t) that is the reference signal divided into frames. Meanwhile, the frame reference signal rx(t) represented in Formula 17 is a frame reference signal rx(t) corresponding to the nth frame (n is a natural number that is 1 or greater). In addition, "L" in the formula is the shift length, and assuming "N" as the frame length, $0 \le t \le N$ holds true about t.

[Formula 17]

$$rx(t)=\mathrm{ref}(t+(n-1)L) \tag{17}$$

Then, the second window signal generating unit 70 obtains the window function w(t) stored in the storage unit 20, and multiplies the obtained window function w(t) by the frame reference signal rx(t) corresponding to the processing-target frame, so as to generate the window signal r(t) represented in Formula 18 below.

[Formula 18]

$$r(t)=rx(t)\times w(t) \tag{18}$$

The second orthogonal transform unit 80 transforms the window signal r(t) that has been input using an orthogonal transform such as MDCT, FFT, wavelet transform or the like for example, so as to generate a spectrum R(f) in the frequency domain composed of the amplitude component |R(f)| and the phase component arg R(f). Then, the second orthogonal transform unit. 80 outputs the amplitude component |R(f)| of the generated spectrum R(f) to the suppression coefficient calculating unit 60, as illustrated in FIG. 16.

The suppression coefficient calculating unit 60 calculates the suppression coefficient G(f) based on the amplitude component |R(f)| of the spectrum R(f) that has been input and the amplitude component |X(f)| output from the orthogonal transform unit 42. Then, the suppression coefficient calculating unit 60 outputs the calculated suppression coefficient G(f) to the gain processing unit 43 of the signal processing apparatus 1, as illustrated in FIG. 16, More specifically, the suppression coefficient calculating unit 60 compares the amplitude component |X(f)| and amplitude component |R(f)| that have been input to calculate similarity, for example, a correlation coefficient, and calculates the suppression coefficient G(f) according to the calculated similarity.

As explained in Embodiments 1 through 3, the suppression process in the frequency domain is performed by the gain processing unit 43 based on the suppression coefficient G(f) calculated as described above, and after that the frame signal y(t) in the time domain is generated by the inverse orthogonal transform unit 44.

When the suppression process is performed using different suppression coefficients G(f) for adjacent frames, there may be a deviation in the amplitudes at both ends of the frame signal y(t), but it becomes possible to correct this deviation according to the method explained in Embodiments 1 through 3 described above.

APPLICATION EXAMPLE 3

Figure 17:
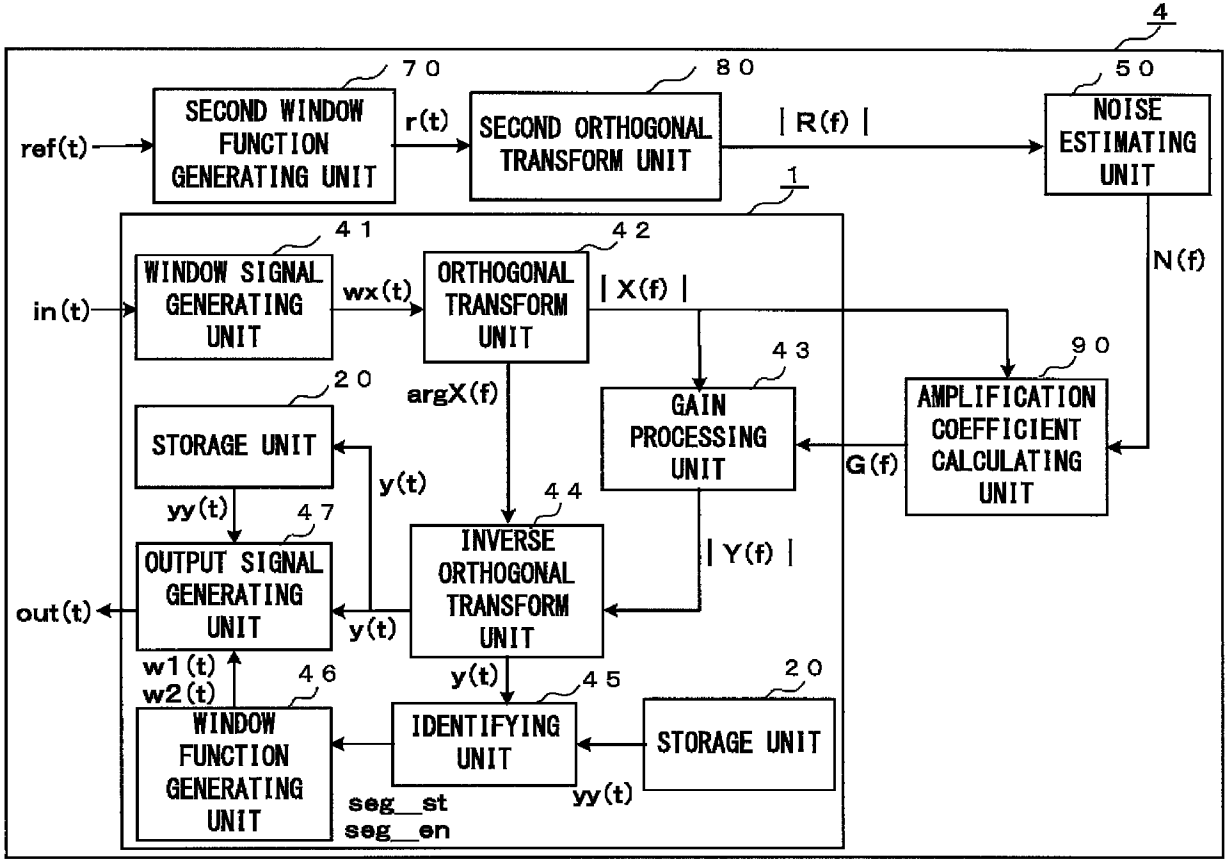
FIG. 17 illustrates a configuration example of a sound emphasis apparatus and the flow of the signal in Application example 3.

This Application example 3 is an example in which the signal processing apparatus 1 is applied to a sound emphasis apparatus 4. FIG. 17 illustrates a configuration example of the sound emphasis apparatus 4 and the flow of the signal in this Application example 3.

The sound emphasis apparatus 4 in this Application example 3 performs a sound emphasis process as an example of the process in the gain processing unit 43, and it is configured to include the noise estimating unit 50, the second window signal generating unit 70, the second orthogonal transform unit 80, and an amplification coefficient calculating unit 90, in addition to the configuration in Embodiment 1.

The second window signal generating unit 70 divides into frames the reference signal ref (t) with respect to the input signal in(t), as explained in Application example 2, so as to generate the window signal r(t) for each frame. Then, the second window signal generating unit 70 sequentially outputs the generated window signal r(t) to the second orthogonal transform unit 80, as illustrated in FIG. 17.

The second orthogonal transform unit 80 transforms the input window signal r(t) using an orthogonal transform such as MDCT, FFT, wavelet transform or the like for example, so as to generate a spectrum R(f) in the frequency domain composed of the amplitude component |R(f)| and the phase component arg R(f). Then, the second orthogonal transform unit 80 outputs the amplitude component |R(f)| of the generated spectrum R(f) to the noise estimating unit 50, as illustrated in FIG. 17.

The noise estimating unit 50 estimates the estimated noise spectrum N(f) based on the amplitude component R(f) output from the second orthogonal transform unit 80. Then, the noise estimating unit 50 outputs the estimated noise spectrum N(f) to the amplification coefficient calculating unit 90, as illustrated in FIG. 17.

More specifically, every time the amplitude component |R(f)| of the spectrum R(f) is input, the noise estimating unit 50 judges whether or not the current frame includes sound, based on the amplitude component |R(f)|, and updates the estimated noise spectrum N(f) when it judges that no sound is included.

That is, the noise estimating unit 50 updates the estimated noise spectrum N(f) according to Formula 19 below, when it is judged that no sound is included in the current frame. Meanwhile, $N_0(f)$ in the formula represents the estimated noise spectrum at the time of processing for the immediately preceding frame, and B is a prescribed constant number.

[Formula 19]

$$N(f)=B\times N_0(f)+(1-B)\times|R(f)| \tag{19}$$

Meanwhile, when it is judged that no sound is included in the current frame the noise estimating unit 50 sets the estimated noise spectrum $N_0(f)$ at the time of processing for the immediately preceding frame as the estimated noise spectrum N(f) for the current frame. That is, in this case, the noise estimating unit 50 outputs the estimated noise spectrum N(f) represented in Formula 20 below to the amplification coefficient calculating unit 90.

[Formula 20]

$$N(f)=N_0(f) \tag{20}$$

The amplification coefficient calculating unit 90 calculates an amplification coefficient G(f) based on the noise spectrum N(f) that has been input and the amplitude component |X(f)| output from the orthogonal transform unit 42. Then, the amplification coefficient calculating unit 90 outputs the calculated amplification coefficient G(f) to the gain processing unit 43 of the signal processing apparatus 1, as illustrated in FIG. 17.

More specifically, the amplification coefficient calculating unit 90 calculates an SNR (Signal-Noise Ratio) according to Formula 21 below. Meanwhile, SNR(f) in the formula is an SNR.

[Formula 21]

$$SNR(f)=|X(f)|/N(f) \tag{21}$$

Then, the amplification coefficient calculating unit 90 calculates the amplification coefficient G(f) according to the calculated SNR. That is, the amplification coefficient calculating unit 90 calculates the amplification coefficient G(f) so as to make the gain large in a case, such as when there is a large noise in the surroundings.

As explained in Embodiments 1 through 3, the amplification process in the frequency domain is performed by the gain processing unit 43 based on the amplification coefficient G(f) calculated as described above, and after that, the frame signal y(t) in the time domain is generated by the inverse orthogonal transform unit 44.

When the suppression process is performed using a different amplification coefficients G(f) for adjacent frames, there may be a deviation in the amplitudes at both ends of the frame signal y(t), but it becomes possible to correct this deviation according to the method explained in Embodiments 1 through 3 described above.

Figure 18:
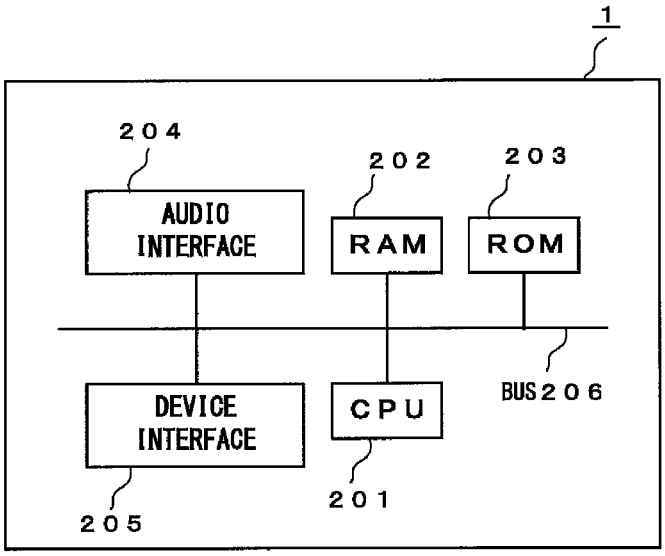
FIG. 18 is a diagram illustrating an example of the hardware configuration of a signal processing apparatus in the embodiments.

FIG. 18 is an example illustrating an example of the hardware configuration of the signal processing apparatus 1 in each embodiment. The signal processing apparatus 1 illustrated in FIG. 1 and so on may be realized with various pieces of hardware illustrated in FIG. 18, for example. In the example in FIG. 18, the signal processing apparatus 1 is equipped with a CPU 201, a RAM 202, a ROM 203, an audio interface 204 for connecting an audio device, and a device interface 205 for connecting an external device or the like, and these pieces of hardware are connected via a bus 206.

The CPU 201 loads an operation program stored in ROM 203 onto the RAM 202 and executes various processes using the RAM 202 as a working memory. The CPU 201 may realize the respective functional units of the control unit 40 illustrated in FIG. 1 and so on by executing the operation program.

Meanwhile, depending on the embodiment, storage apparatuses of other types that are different from the RAM 202 and the ROM 203 may be used. For example, the signal processing apparatus 1 may include a storage apparatus such as a CAM (Content Addressable Memory), an SRAM (Static Random Access Memory), an SDRAM (Synchronous Dynamic Random Access Memory), and the like.

Meanwhile, depending on the embodiment, the hardware configuration of the signal processing apparatus 1 may be different from that in FIG. 18, and other pieces of hardware of standards and types that are different from those in FIG. 18 may be applied to the signal processing apparatus 1.

For example, the respective functional units of the control unit 40 of the signal processing apparatus 1 illustrated in FIG. 1 and so on may be realized by a hardware circuit. Specifically, the respective functional units of the control unit 40 of the signal processing apparatus 1 illustrated in FIG. 1 and so on may be realized by a reconfigurable circuit such as an FPGA (Field Programmable Gate Array), ASIC (Application Specific Integrated Circuit), or the like, instead of the CPU 201. Of course, these functional units may also be realized by both the CPU 201 and a hardware circuit.

Some embodiments are explained above. However, it is to be understood that the embodiments are not limited to the embodiments described above and include various modified forms and alternative forms of the embodiments described above. For example, it is to be understood that various embodiments may be embodied by modifying the constituent elements without departing from their spirit and scope. In addition, it is to be understood that various embodiments may be made by appropriately combining a plurality of constituent elements disclosed in the embodiments described above. Furthermore, it is to be understood by persons skilled in the art that various embodiments may be implemented by deleting or replacing some constituent elements from the entirety of the constituent elements represented in the embodiments, or by adding some constituent elements to the constituent elements represented in the embodiments.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments) of the present invention have been described in detail, it should be understood that the various changes, substitutions, and alterations could be made hereto without departing from the spirit and scope of the invention.

What is claimed is:

1. An audio signal processing apparatus comprising:

a memory; and a processor which executes a process in a communication with the memory, the process including:

generating a first frame signal by multiplying a divided input audio signal by a prescribed first window function, the divided input audio signal being included in a divided signal string generated by dividing an audio input signal into frames of a prescribed frame length;

transforming the first frame signal into a frequency spectrum;

adjusting an amplitude component of the frequency spectrum;

applying inverse transform to the amplitude component after adjustment and to a phase component of the frequency spectrum to generate a second frame signal in a time domain;

identifying a segment in an overlapping section between the second frame signal and an immediately preceding frame signal of the second frame signal such that an absolute value of an amplitude of the second frame signal at a start end of the segment becomes smaller than an absolute value of an amplitude of the second frame signal at a terminal end of the overlapping section, the immediately preceding frame signal being generated from a immediately preceding divided input audio signal of the divided input audio signal in the divided signal string; and in the identified segment, adding the immediately preceding frame signal and the second frame signal.

2. The audio signal processing apparatus according to claim 1, wherein the process further includes:

generating a second window function that is a window function whose window length is equal to a width of the segment and that makes an amplitude of the second frame signal at a start end of the segment substantially zero and that substantially does not change an amplitude of the second signal at a terminal end of the segment; and generating a third window function that is a window function whose window length is equal to the width of the segment and that makes an amplitude of the immediately preceding frame signal at the terminal end of the segment substantially zero and that substantially does not change an amplitude of the immediately preceding frame signal at the start end of the segment, wherein in the adding, a first window signal obtained by multiplying the second frame signal by the second window function is added to a second window signal obtained by multiplying the immediately preceding frame signal by the third window function, in the identified segment.

3. The audio signal processing apparatus according to claim 1, wherein the process further includes:

generating a first signal for correction whose frame length is equal to a frame length of the second frame signal and that makes an amplitude of the second frame signal at a start end of the segment substantially zero when the first signal for correction is added to the second frame signal; and generating a second signal for correction whose frame length is equal to a frame length of the second frame signal and that makes the amplitude of the immediately preceding frame signal at a terminal end of the segment substantially zero when the second signal for correction is added to the immediately preceding frame signal, wherein in the adding, a corrected first frame signal obtained by adding the second frame signal and the first signal for correction is added to a corrected second frame signal obtained by adding the immediately preceding frame signal and the second signal for correction, in the identified segment.

4. The audio signal processing apparatus according to claim 3, wherein the first signal for correction and/or the second signal for correction is a direct-current signal.

5. The audio signal processing apparatus according to claim 1, wherein in the identifying of the segment, the segment is identified by identifying a start end such that, in the overlapping section, an absolute value of an amplitude of the second frame signal at a start end of the segment becomes substantially a minimum, and by identifying a terminal end such that an absolute value of an amplitude of the immediately preceding frame signal at a terminal end of the segment becomes substantially a minimum.

6. The audio signal processing apparatus according to claim 1, wherein in the identifying of the segment, the segment is identified by identifying a start end such that, in the overlapping section, an absolute value of an amplitude of the second frame signal at a start end of the segment becomes equal to or smaller than a prescribed threshold, and by identifying a terminal end such that an absolute value of the amplitude of the immediately preceding frame signal at a terminal end of the segment becomes equal or smaller than the threshold.

7. The audio signal processing apparatus according to claim 1, wherein in the identifying of the segment, the segment is identified such that a width of the segment becomes a maximum in the segment that satisfies a condition.

8. An audio signal processing method comprising:

generating, by using a processor, a first frame signal by multiplying a divided input audio signal by a prescribed first window function, the divided input audio signal being included in a divided signal string generated by dividing an audio input signal into frames of a prescribed frame length;

transforming, by using the processor, the first frame signal into a frequency spectrum;

adjusting, by using the processor, an amplitude component of the frequency spectrum;

applying, by using the processor, inverse transform to the amplitude component after adjustment and to a phase component of the frequency spectrum to generate a second frame signal in a time domain;

identifying, by using the processor, a segment in an overlapping section between the second frame signal and an immediately preceding frame signal of the second frame signal such that an absolute value of an amplitude of the second frame signal at a start end of the segment becomes smaller than an absolute value of an amplitude of the second frame signal at a terminal end of the overlapping section, the immediately preceding frame signal being generated from a immediately preceding divided input audio signal of the divided input audio signal in the divided signal string; and in the identified segment, adding, by using the processor, the immediately preceding frame signal and the second frame signal.

9. A non-transitory computer readable recording medium having stored therein a program for causing a computer to execute an audio signal processing, the processing comprising:

generating, by the computer, a first frame signal by multiplying an input signal divided into frames of a prescribed frame length by a prescribed first window function;

transforming, by the computer, the first frame signal into a frequency spectrum;

adjusting, by the computer, an amplitude component of the frequency spectrum;

applying, by the computer, inverse transform to the amplitude component after adjustment and to a phase component of the frequency spectrum to generate a second frame signal in a time domain;

identifying, by the computer, a segment in an overlapping section between the second frame signal and an immediately preceding frame signal of the second frame signal such that an absolute value of an amplitude of the second frame signal at a start end of the segment becomes smaller than an absolute value of an amplitude of the second frame signal at a terminal end of the overlapping section, the immediately preceding frame signal being generated from a immediately preceding divided input audio signal of the divided input audio signal in the divided signal string; and in the identified segment, adding, by the computer, the immediately preceding frame signal and the second frame signal.

* * * * *